US011296465B2

(12) United States Patent
Gruber

(10) Patent No.: US 11,296,465 B2
(45) Date of Patent: Apr. 5, 2022

(54) ELECTRICAL PLUG-IN CONNECTION, ASSEMBLY CONNECTION AND CIRCUIT BOARD ARRANGEMENT

(71) Applicant: Rosenberger Hochfrequenztechnik GmbH & Co. KG, Fridolfing (DE)

(72) Inventor: Andreas Gruber, Ainring (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 16/723,324

(22) Filed: Dec. 20, 2019

(65) Prior Publication Data

US 2020/0203901 A1 Jun. 25, 2020

(30) Foreign Application Priority Data

Dec. 21, 2018 (EP) ..... 18215544
Nov. 15, 2019 (EP) ..... 19209296

(51) Int. Cl.
*H01R 24/40* (2011.01)
*H01R 13/627* (2006.01)
(Continued)

(52) U.S. Cl.
CPC ..... *H01R 24/40* (2013.01); *H01R 12/7082* (2013.01); *H01R 12/716* (2013.01);
(Continued)

(58) Field of Classification Search
CPC ..... H01R 13/6315; H01R 13/111; H01R 13/2407; H01R 13/20; H01R 11/09;
(Continued)

(56) References Cited

U.S. PATENT DOCUMENTS 3,871,735 A * 3/1975 Herrmann, Jr. ..... H01R 13/53 439/585
4,377,320 A * 3/1983 Lathrop ..... H01R 24/40 439/585

(Continued)

FOREIGN PATENT DOCUMENTS

CN 201717406 U 1/2011
DE 2022015007010 U1 10/2015

(Continued)

OTHER PUBLICATIONS

European Search Report, Application No. 18215544.0, dated Sep. 6, 2019.

(Continued)

*Primary Examiner* — Oscar C Jimenez
*Assistant Examiner* — Paul D Baillargeon
(74) *Attorney, Agent, or Firm* — Randall Danskin P.S.

(57) ABSTRACT

An electrical plug-in connection provides a connecting element having an electrically conductive outer housing with a first electrical plug-in connector at a first end that has a ring-segment shaped first contact region, and a first electrical counterpart plug-in connector having contact springs that act via the first contact region to produce electrical contact and a mechanical connection between the first plug-in connector and the first counterpart plug-in connector and the contact springs generate an axial force which acts along a longitudinal axis of the first counterpart plug-in connector which pushes the outer housing against an axial end stop of the first counterpart plug-in connector, and/or the contact springs exert on the first contact region and on a ring-segment shaped, and axially offset, second contact region a radial force, which acts orthogonally with respect to the longitudinal axis of the first counterpart plug-in connector.

13 Claims, 7 Drawing Sheets

(51) Int. Cl.

| | |
|---|---|
| ***H01R 12/71*** | (2011.01) |
| ***H01R 13/187*** | (2006.01) |
| ***H01R 12/70*** | (2011.01) |
| ***H01R 103/00*** | (2006.01) |

(52) U.S. Cl.
CPC ..... *H01R 13/187* (2013.01); *H01R 13/627* (2013.01); *H01R 2103/00* (2013.01)

(58) Field of Classification Search
CPC .. H01R 13/187; H01R 24/40; H01R 12/7082; H01R 12/716; H01R 13/627; H01R 2103/00
See application file for complete search history.

(56) References Cited

U.S. PATENT DOCUMENTS

| | | | | |
|---|---|---|---|---|
| 4,963,105 | A | 10/1990 | Lewis | |
| 6,488,512 | B2 | 12/2002 | Gonzales | |
| 6,497,579 | B1 * | 12/2002 | Garbini | H01R 13/6315 439/63 |
| 6,692,286 | B1 | 2/2004 | De Cet | |
| 7,238,047 | B2 | 7/2007 | Sattele et al. | |
| 10,249,968 | B2 | 4/2019 | Dandl et al. | |
| 10,658,803 | B2 * | 5/2020 | Gartmann | H01R 13/506 |
| 2006/0099853 | A1 * | 5/2006 | Sattele | H01R 24/40 439/578 |

FOREIGN PATENT DOCUMENTS

| | | | | |
|---|---|---|---|---|
| EP | 1154527 | A1 | 11/2001 | |
| EP | 1641086 | A1 | 3/2006 | |
| EP | 1746691 | A2 | 1/2007 | |
| JP | 2006260898 | A | 9/2006 | |
| WO | 2007085099 | A1 | 8/2007 | |
| WO | 2011088902 | A1 | 7/2011 | |
| WO | WO-2017059950 | A1 * | 4/2017 | H01R 12/7082 |

OTHER PUBLICATIONS

Office Action issued by the European Patent Office dated Feb. 27, 2020.

Notice of Opposition received in the parallel European Patent Application No. 18 215 544.0.

* cited by examiner

ELECTRICAL PLUG-IN CONNECTION, ASSEMBLY CONNECTION AND CIRCUIT BOARD ARRANGEMENT

RELATED APPLICATIONS

This patent application claims priority to European Patent Application No. EP 18 215 544.0 which was filed on Dec. 21, 2018, and also claims priority to European Patent Application No. EP 19 209 296.3 which was filed on Nov. 15, 2019. The entire contents of the aforementioned two European Patent Applications are expressly and fully incorporated herein by this reference.

BACKGROUND

The invention relates to an electrical plug-in connection, comprising a connecting element with a first electrical plug-in connector arranged at a first end and comprising a first electrical counterpart plug-in connector.

The invention also relates to a counterpart plug-in connector and to a connecting element.

The invention furthermore relates to an assembly connection for connecting a first electrical assembly and a second electrical assembly.

The invention furthermore relates to a circuit board arrangement, comprising at least one first circuit board and one second circuit board, as per the preamble of claim 15.

Electrical assemblies usually have electronic circuits that are implemented on circuit boards ("Printed Circuit Boards", PCBs) by interconnecting a plurality of electronic components. Multiple circuit boards are frequently provided within one assembly in order, for example, to distribute a circuit spatially in a housing or enclosure or to connect different modules together into one assembly. In general, with this construction, an electrical connection between the different circuit boards is necessary for an exchange of signals and/or energy. An electrical connection between different circuit boards may for example also be necessary if a plurality of electronic assemblies are to be connected together for communication. There are, in general, various reasons for connecting multiple electrical circuit boards together.

Various possibilities are known for the electrical connection of circuit boards, including unshielded plug-in connectors, stranded wires and ribbon cables. Such connections are also known under the name of "board-to-board" connection. The conventional connections are however generally inadequate, in particular for high-frequency technology.

In order to connect two circuit boards together electrically, coaxial connecting elements are frequently used for the transmission of signals for high-frequency technology, in order to ensure a sufficiently high signal quality. In practice, a coaxial plug-in connector of the connecting element is connected in each case here to a counterpart plug-in connector mounted on a circuit board. The counterpart plug-in connector is preferably soldered to the circuit board, or pressed and connected electrically to striplines of the circuit board. A coaxial intermediate piece, also known as an "adapter", connects the two coaxial plug-in connectors, and thus bridges the distance between the two circuit boards in order to enable the signal exchange.

In general, the known coaxial connecting elements comprise an inner conductor and an outer conductor that is electrically insulated by means of an insulating part or dielectric from the inner conductor, which inner conductor and outer conductor are each manufactured as turned parts.

In general, the manufacture of the components by means of turning is necessary in order to achieve sufficiently good manufacturing tolerances and to permit a press fit. In particular, if the connecting element is to be used for high-frequency technology, the requirements on the manufacturing tolerances are particularly high.

In more recent product generations of the connecting elements, there are furthermore increasingly high demands placed on the miniaturization thereof. Here, it is firstly sought to minimize the spacing between the circuit boards, and also the spacing ("pitch") between two adjacent circuit board plug-in connectors (hereinafter encompassed by the expression "counterpart plug-in connector").

Furthermore, the installation and alignment of the connecting elements has over time become relatively complex, not least owing to the miniaturization.

The present invention addresses the object of simplifying the construction and the installation of an electrical plug-in connection, in particular while retaining the electrical transmission properties suitable for high-frequency technology.

The invention furthermore addresses the object of providing a corresponding counterpart plug-in connector and a corresponding connecting element of an electrical plug-in connector with improved construction and simplified installation.

The present invention furthermore addresses the object of simplifying the construction and the installation of an assembly connection for connecting a first electrical assembly to a second electrical assembly, in particular while retaining the electrical transmission properties suitable for high-frequency technology.

The present invention also addresses the object of providing a circuit board arrangement which is in particular easy to install, while retaining the electrical transmission properties suitable for high-frequency technology.

The object is achieved for the electrical plug-in connection by means of claim 1, for the counterpart plug-in connector by means of claim 10, and for the connecting element by means of claim 11. The object is achieved with regard to the assembly connection by means of the features of claim 13 and with regard to the circuit board arrangement by means of the features of claim 15.

The dependent claims concern advantageous forms of embodiment and variants of the invention.

An electrical plug-in connection is provided which comprises a connecting element with a first electrical plug-in connector arranged at a first end. The electrical plug-in connection furthermore comprises a first electrical counterpart plug-in connector. The first counterpart plug-in connector comprises contact springs and the first plug-in connector comprises an electrically conductive outer housing with a first contact region which runs at least in ring-segment-shaped circumferential fashion. The contact springs act via the first contact region on the outer housing in order to produce electrical contact and a mechanical connection between the first plug-in connector and the first counterpart plug-in connector.

The first electric counterpart plug-in connector is preferably designed as a counterpart plug-in connector of a first electrical assembly, preferably as a circuit board plug-in connector of a first electrical circuit board.

Where reference is made in the context of the invention to a contact region which runs at least in ring-segment-shaped circumferential fashion, for example to a first contact region which runs at least in ring-segment-shaped circumferential fashion or to a second contact region which runs at least in ring-segment-shaped circumferential fashion, this is to be understood to mean a contact region which preferably runs in fully ring-shaped circumferential fashion around the outer housing. The contact region may however also run in (ring-segment-shaped, or ring-shaped) circumferential fashion only along an angle portion or angle segment around the outer housing or may run in ring-segment-shaped, or ring shaped, circumferential fashion along multiple angle portions distributed around the outer housing.

The outer housing may in particular be formed as one piece with the outer housing of the connecting element. The first plug-in connector may however also comprise an outer housing which differs from the outer housing of the connecting element.

The outer housing may be entirely conductive or else may be designed to be conductive only in certain portions. The outer housing may for example also comprise electrically non-conductive constituents.

In the context of the invention, any number of contact springs may be provided, for example two contact springs, three contact springs, four contact springs, five contact springs, six contact springs, seven contact springs, eight contact springs or more contact springs.

Provision may be made whereby the contact springs form a spring cage.

It is not necessary in the context of the invention for the contact springs to act in fully circumferential fashion on the first contact region.

It is preferable if all contact springs act on the first contact region in the same axial height plane, wherein tolerance-induced and/or installation-induced deviations may be possible.

The contact springs may also be referred to as "spring lugs" or "outer conductor spring lugs".

According to the invention, provision is made whereby the contact springs act on the first contact region such that the outer housing is acted on with an axial force which acts along a longitudinal axis of the first counterpart plug-in connector and which pushes the outer housing against an axial end stop of the first counterpart plug-in connector. Alternatively or in addition, provision is made whereby the contact springs are designed such that they exert on the first contact region and on a second contact region of the outer housing, which second contact region runs at least in ring-segment-shaped, or ring shaped, circumferential fashion and is axially offset with respect to the first contact region along a longitudinal axis of the connecting element, a respective radial force, which acts orthogonally with respect to the longitudinal axis of the first counterpart plug-in connector, on the outer housing.

The longitudinal axis of the connecting element may preferably be an axis of symmetry of the connecting element. The longitudinal axis of the first plug-in connector may preferably be an axis of symmetry of the first plug-in connector.

The axial force and/or radial force according to the invention may be a force component of the spring force of the contact springs.

In a preferred refinement of the invention, provision may be made whereby the outer diameter of the first contact region increases in the direction of the first end of the connecting element.

In particular, by means of this design of the first contact region, it is possible to realize an axial force component, or the axial force according to the invention, in order to push the first plug-in connector or the connecting element against the end stop.

In one refinement of the invention, provision may furthermore be made whereby the contact springs are designed so as to act on the outer housing via the second contact region.

In this way, a radial force component, or the radial force according to the invention, can be realized.

Preferably, the first contact region and/or the second contact region may have an outer diameter which is constant in an axial direction, for example may be of cylindrical design. Provision may then for example be made for the self-centering function of the connecting element to be realized by means of radial contact in a cylindrical region, if the contact regions and the contact springs are in each case arranged so as to be axially offset.

According to the invention, self-centering of the connecting element or of the first plug-in connector of the connecting element may be provided in the first counterpart plug-in connector. Owing to this self-centering, the "catching region" (also referred to as receiving region or insertion region) for the first plug-in connector in the first counterpart plug-in connector can be reduced in size, and thus the first counterpart plug-in connector as a whole can be made more compact.

In one embodiment of the invention, provision may be made in particular whereby the contact springs, the first contact region and/or the second contact region are designed such that the contact springs exert a radial force component and an axial force component on the outer housing such that the longitudinal axis of the first plug-in connector assumes an alignment parallel to the longitudinal axis of the first counterpart plug-in connector.

The parallel alignment of the longitudinal axes of the first plug-in connector or of the connecting element and of the first counterpart plug-in connector can lead to an orthogonal alignment of the connecting element on the end stop.

In the context of the invention, self-centering of the first plug-in connector in the first counterpart plug-in connector can be understood to mean centering, that is to say a compensation of a lateral offset of the longitudinal axes of the first plug-in connector and of the first counterpart plug-in connector and/or an orthogonal alignment of the longitudinal axis of the connecting element with respect to the end stop, or a parallel alignment of the longitudinal axes of the connecting element and of the first counterpart plug-in connector, that is to say a compensation of a tilt or an oblique position of the first plug-in connector in the first counterpart plug-in connector. It is preferable if the longitudinal axes of the connecting element and of the first counterpart plug-in connector are aligned concentrically or coaxially. Self-centering according to the invention may also be understood to mean merely an improvement in the position and/or orientation of the first plug-in connector in the first counterpart plug-in connector, whereby the longitudinal axis of the connecting element and the longitudinal axis of the counterpart plug-in connector at least move closer together.

The invention may basically be suitable for at least reducing an offset of the first plug-in connector in the first counterpart plug-in connector and/or an oblique position of the first plug-in connector in the first counterpart plug-in connector. In particular, a tolerance-induced offset of the first plug-in connector in the first counterpart plug-in connector may remain, and/or a tolerance-induced oblique position of the first plug-in connector in the first counterpart plug-in connector may remain.

The longitudinal axes of the connecting element and of the first counterpart plug-in connector however preferably run coaxially after the self-centering according to the invention.

In one refinement of the invention, provision may be made whereby the first counterpart plug-in connector comprises a counterpart plug-in connector housing with a funnel-shaped insertion region for the first plug-in connector.

A funnel-shaped insertion region, in particular a conical receptacle for the first plug-in connector, can further simplify the installation of the electrical plug-in connection. In particular, "blind" plugging of the first plug-in connector into the first counterpart plug-in connector can be made possible.

According to the invention, the diameter of the insertion region and thus the diameter of the counterpart plug-in connector housing as a whole can be reduced owing to the self-centering according to the invention of the first plug-in connector in the first counterpart plug-in connector.

In one embodiment of the invention, provision may be made whereby the contact springs form two groups which are axially offset along the longitudinal axis of the first counterpart plug-in connector and which are arranged such that the first group of the contact springs is capable of acting on the outer housing via the first contact region, and the second group of contact springs is capable of acting on the outer housing via the second contact region.

By means of this embodiment, it is possible in particular for an oblique position of the connecting element or of the first plug-in connector in the first counterpart plug-in connector to be prevented or at least reduced, because the first plug-in connector will, in the first counterpart plug-in connector, seek to assume as linear as possible a course between the two groups of the contact surfaces owing to the contact springs acting in an axially offset manner.

In one refinement of the invention, provision may be made whereby the contact springs are mechanically preloaded in the first counterpart plug-in connector.

The contact springs may thus already be in a pre-deflected state before the first plug-in connector is inserted into the first counterpart plug-in connector.

A preload of the contact springs may be advantageous in particular if the outer diameter of the first contact region increases in the direction of the first end of the connecting element, because the thus widened first end of the connecting element causes a greater radial deflection of the contact springs and thus a higher plugging-in force in relation to a conventional connecting element. The preload of the contact springs may be expedient for compensating this. In this way, those surface regions of the individual contact springs which make axial contact with the end surface of the connecting element or with the first end of the connecting element during the plugging-in process can be reduced. The inventor has recognized that, owing to this fact alone, the plugging-in force of the connecting element can already be advantageously reduced.

In one refinement, provision may be made whereby the counterpart plug-in connector housing comprises a collar which projects into the first counterpart plug-in connector and which is designed as an abutment for the contact springs in order to mechanically preload the contact springs.

The collar or flange of the counterpart plug-in connector housing may preferably run in fully ring-shaped circumferential fashion. Provision may however also be made whereby the collar runs only in part-ring-shaped circumferential fashion or in circumferential fashion in a distributed manner along at least one angle portion, in particular in the radial sections in which the contact springs are situated in the first counterpart plug-in connector. The contact springs may be preloaded in each case individually, in arbitrary groups or jointly on a collar running in fully circumferential fashion.

The collar of the counterpart plug-in connector for preloading the contact springs may preferably form the funnel-shaped insertion region.

It is preferable for a metallic bracing device or a metallic collar to be provided for preloading the contact springs.

The preloading of the contact springs may be advantageous, because then the catching region or the insertion region of the counterpart plug-in connector (that is to say in particular the region from the contacting plane to the end of the contact springs) can be made shorter. It is thus possible for the "bracing device" which is used for the preloading, in particular the generally cup-shaped collar of the counterpart plug-in connector housing, to perform the main task of the insertion region or catching funnel.

According to the invention, the axial length of the contact springs or of a spring cage can be shortened owing to the reduced insertion region or catching region.

Through the use of a softer spring material, it is furthermore possible for the resilient region of the contact springs to be reduced in size.

A funnel-shaped insertion region may furthermore form a touch protection means for the contact springs and/or for an inner conductor spring cage of the counterpart plug-in connector.

The use of a collar of the counterpart plug-in connector housing for preloading the contact springs may firstly be advantageous because a collar can be realized in a technically simple manner by means of a deformation of the free end of the counterpart plug-in connector housing, and a correspondingly formed collar can simultaneously serve for forming the funnel-shaped insertion region for the first plug-in connector.

The mechanical preloading of the contact springs may give rise to the need for a smaller additional deflection of the contact springs, in relation to the situation without preloading, when the first plug-in connector is inserted into the first counterpart plug-in connector, wherein the required contact force may nevertheless be realizable. In this way, it is advantageously possible for a spring cage to be usable, or for contact springs with a higher degree of spring elasticity to be usable.

The contact springs may in particular be preloaded in the first counterpart plug-in connector in the installed state thereof, in order to be able to use contact springs with a shallower spring characteristic curve. This can yield certain advantages. In particular, the resilient region of the contact springs or of the contact region in the first counterpart plug-in connector can be shortened, which can minimize the structural space. Furthermore, the spring material is less intensely loaded, whereby a less expensive spring material can be used. Finally, the extent to which the contact springs must be widened during a plugging-together of the first plug-in connector with the first counterpart plug-in connector is reduced, whereby the insertion region of the contact springs can be made shorter, which can further reduce the structural space. Finally, furthermore, the insertion region of the contact springs can shorten the catching funnel or the funnel-shaped insertion region of the first counterpart plug-in connector.

In one embodiment of the invention, provision may for example be made whereby the contact springs are formed from a material with a low modulus of elasticity, in particular from a material with a modulus of elasticity of 200 GPa or less, preferably 150 GPa or less, particularly preferably 100 GPa or less.

For example, brass, spring bronze or copper beryllium may be provided as material for forming the contact springs.

Through the use of a corresponding material, a higher degree of spring elasticity can be achieved. In general, a further advantage of a relatively soft spring material is that it is less expensive.

In one embodiment of the invention, provision may furthermore be made whereby the contact springs are slotted, in particular longitudinally slotted.

Provision may also be made for specific geometries to be provided for the contact springs, for example long and narrow contact springs. By means of a corresponding geometry and possibly additional slotting of the contact springs, it is also possible for contact springs with a relatively high degree of spring elasticity to be provided.

In one refinement of the invention, provision may be made whereby the outer diameter of the first contact region increases conically, in particular in linear, convex or concave fashion, in the direction of the first end of the connecting element.

The first contact region may thus in particular also be of domed, for example concave or convex, form.

The self-centering according to the invention may preferably be achievable by means of the contact of the contact springs with a cone, whereby an axial force component can be provided which pushes the connecting element into the counterpart plug-in connector and for example against an axial end stop, in particular an axial end stop formed by an insulating part, and thus aligns said connecting element.

According to the invention, the manner in which the outer diameter of the first contact region increases is basically not of importance. A linear increase of the outer diameter is preferably provided. It is however basically possible for any curve course to be provided for the increase of the outer diameter of the first contact region.

In one refinement of the invention, provision may be made whereby the first counterpart plug-in connector comprises an insulating part which, as the first plug-in connector is plugged together with the first counterpart plug-in connector, at least partially enters the outer housing of the first plug-in connector.

Provision may be made whereby the connecting element has one or more inner conductors led within the outer housing.

The at least one inner conductor may enter a receptacle of the insulating part and possibly make mechanical and electrical contact with a contact element, received within the insulating part, of the first counterpart plug-in connector.

In one refinement of the invention, provision may be made whereby the insulating part makes contact with the outer housing at an inner contact region, which is situated opposite the first contact region, of the outer housing, in particular when the first plug-in connector and the first counterpart plug-in connector have been plugged together, preferably fully plugged together.

The inner contact region is preferably formed on an inner surface of the outer housing, which inner surface is situated opposite an outer surface, which forms the contact region, of the outer housing.

The inner contact region preferably follows the geometry of the contact region.

Provision may be made whereby the inner diameter of the inner contact region increases in the direction of the first end of the connecting element. Preferably, the inner diameter of the inner contact region increases conically, in particular in linear, convex or concave fashion, in the direction of the first end of the connecting element.

In one refinement, provision may be made whereby the insulating part forms a collar pointing in the direction of the outer housing, in order to center the outer housing in the first counterpart plug-in connector.

The collar or flange of the insulating part may in particular be formed at that free end of the insulating part which faces toward the connecting element.

A collar running in fully ring-shaped circumferential fashion is preferably formed on the insulating part. Provision may however also be made of a collar which runs around the insulating part only in part-ring-shaped circumferential fashion or in circumferential fashion in a distributed manner along at least one angle portion.

The collar of the insulating part may in particular serve for preventing asymmetry between the first plug-in connector of the connecting element and the first counterpart plug-in connector, and for ensuring concentricity between the first plug-in connector and the first counterpart plug-in connector.

While the contact springs generally primarily effect a correction of an oblique position of the connecting element by means of the interaction with the first contact region and/or with the second contact region, the collar of the insulating part makes it possible to avoid or at least reduce a spacing of the longitudinal axes of the connecting element and of the first counterpart plug-in connector.

By means of a collar at the distal end of the insulating part, symmetry can be realized which makes it possible to achieve that, in the plugged-in state of the first plug-in connector, all of the contact springs no longer make contact by way of their distal ends with the bracing device or with the collar, which serves for preloading the contact springs, of the plug-in connector housing. It is possible in this way to avoid a second signal path at the outer conductor via the counterpart plug-in connector housing or the collar thereof, which would otherwise form a closed signal path, in the manner of a loop or inductance, via the signal path of the contact springs. By means of the collar of the insulating part, the excitation of undesired harmonics of a high-frequency signal can however be prevented, and the electrical plug-in connection can be particularly suitable for use in high-frequency technology.

By means of the collar on the insulating part, it is possible in the plugged-together state of the first plug-in connector and of the first counterpart plug-in connector for the radial movement of the connecting element or a radial and/or lateral offset between the longitudinal axis of the connecting element and the longitudinal axis of the first counterpart plug-in connector to be prevented or at least minimized. This may be advantageous in order to prevent the undesired contact between the free end of the contact springs and the counterpart plug-in connector housing or the outer housing.

In one advantageous refinement of the invention, provision may be made whereby the collar of the insulating part makes contact with the outer housing at the inner contact region of the outer housing, in particular when the first plug-in connector and the first counterpart plug-in connector have been plugged together, preferably fully plugged together.

In this way, the self-centering of the connecting element can be further improved, in particular when the outer housing is mechanically braced between the contact springs and the collar of the insulating part.

The contact points at which the contact springs make contact with the outer housing at the first contact region and at which the collar of the insulating part makes contact with the outer housing at the inner contact region are preferably axially offset along the longitudinal axis of the connecting element, in particular in order to exert a radial force, which acts orthogonally with respect to the longitudinal axis of the first counterpart plug-in connector, on the outer housing. Provision may however also be made whereby the contact points are not axially offset along the longitudinal axis of the connecting element.

In one refinement, provision may furthermore be made whereby the insulating part forms the axial end stop for the first plug-in connector in the first counterpart plug-in connector.

The invention also relates to a counterpart plug-in connector (the "first counterpart plug-in connector") for an electric plug-in connection as described above and below.

The invention furthermore relates to a connecting element for an electrical plug-in connection according to the statements made above and below.

According to the invention, a high degree of electromagnetic compatibility of the connecting element can be provided.

The connecting element according to the invention may be suitable in particular for transmitting electrical signals up to 8 GHz or more.

In one refinement, provision may be made whereby the connecting element is designed for connecting a first electrical assembly to a second electrical assembly and comprises a rigid, tubular outer housing made of an electrically conductive material and also an electrical cable running inside the outer housing along a longitudinal axis of the outer housing.

If this is a coaxial cable with an inner conductor, the longitudinal axis of the outer housing runs coaxially with respect to, or coincides with, the longitudinal axis of the inner conductor. The longitudinal axis may also be defined as being the axis that results when the centers of area of the cross-sectional areas of the outer housing are connected to one another.

The outer housing preferably surrounds the electrical cable in tubular fashion.

The connecting element may preferably be of coaxial design in such a way that the longitudinal axes of the electrical cable and of the outer housing are coincident.

The outer housing does not have to be designed to enclose the electrical cable completely, and, in the context of the invention, may guide the electrical cable within itself even if it has cut-outs, in particular holes and/or slots.

In the refinement, provision may be made whereby the electrical cable has at least one inner conductor and a dielectric surrounding the at least one inner conductor.

The at least one dielectric surrounding the inner conductor may in particular also be a cable jacket.

The electrical cable may preferably also be a "cable blank", i.e. an unfinished electrical cable in which at least one inner conductor has firstly been overmolded with a surrounding dielectric—whereby further potential manufacturing steps are omitted. It may in particular be a cable blank of a coaxial cable in which a coaxial outer conductor (e.g. a cable shield braid and/or a shield foil) and a cable jacket have not yet been mounted on the dielectric surrounding the inner conductor.

Instead of a cable, provision may also be made of a dielectric of any form with one or more inner conductors running therein, which are surrounded by the outer housing. For example, the inner conductor and/or the dielectric may be produced as (a) turned part(s).

In the refinement, provision may furthermore be made whereby at least one segment of the outer housing is deformed along the longitudinal axis in such a way that the electrical cable is fixed inside the outer housing.

Since the connecting element of the refinement may be composed of a tubular outer housing that can be manufactured in any desired manner and of a commercially standard electrical cable or cable blank held inside the outer housing, it can, in contrast to the known, turned connecting elements of the prior art, be manufactured economically. The connecting element can thus in particular be suitable for large-scale manufacture. In the context of the invention, the connecting element may however also be a turned part.

As a result of the fact that the outer housing can, according to the refinement, be deformed, that is to say plastically brought into a different shape in a targeted manner without material thereby being removed from or added to the outer housing, a high mechanical holding force of the electrical cable inside the outer housing can be provided in spite of high manufacturing tolerances of the outer housing and/or of the electrical cable which may be present. It is thus possible in particular to use an outer housing and/or an electrical cable that has comparatively large manufacturing tolerances, since a corresponding play between the outer housing and the electrical cable can be compensated through the subsequent deformation.

Furthermore, the electrical matching for the transmission of signals in the high-frequency range may also be optimized through the deformation.

The connecting element may advantageously be usable in particular for the transmission of electrical signals in high-frequency technology. Fundamentally, however, the connecting element may be suitable for any signal and/or energy transmissions in the entire field of electrical engineering.

The connecting element may preferably be suitable for the mechanical and electrical connection of two circuit boards. Fundamentally, however, the connecting element according to the invention may also be provided for the mechanical and electrical connection of other electrical or electronic assemblies, for example for connecting together control devices, filters, antennas or other modules. For the sake of simplicity, the invention will be described below for the electrical and mechanical connection of two circuit boards. The term "circuit board" can however be readily applied by an expert to any desired electrical or electronic assembly and correspondingly substituted.

In the context of the invention, the outer housing of the connecting element may serve as the outer conductor of the connecting element in the transmission of electrical signals between the circuit boards by means of the inner conductor of the electrical cable.

In one embodiment of the connecting element, provision may be made whereby the outer housing comprises a first plug-in connector at a first end, and a second plug-in connector at a second end, for connection to a respective counterpart plug-in connector of an electrical assembly, in particular of a circuit board.

In a particularly simple embodiment, preferred in particular for connecting circuit boards, the plug-in connectors at the ends of the outer housing may also be formed by virtue of the ends of the outer housing being widened and a plug-in connector thereby being formed. The inner conductor (for example of the electrical cable) may possibly protrude out of the dielectric from the ends in a forward portion suitable for the contacting, or the dielectric may be removed in this forward portion.

The plug-in connectors at the respective ends of the outer housing may also be referred to as "heads" of the connecting element, and the region lying between the plug-in connectors as the "adapter".

The plug-in connectors formed at the ends of the outer housing may be designed as interfaces for connecting to arbitrary other plug-in connectors or counterpart plug-in connectors.

The plug-in connectors at the ends of the outer housing are preferably designed to be round and coaxial. By means of the plug-in connection between a plug-in connector and a respective counterpart plug-in connector, the connecting element can be connected mechanically and electrically to the corresponding circuit board (or to another, arbitrary, electrical assembly).

The connecting element, the outer housing and/or the inner conductor may also pass through a cut-out in at least one of the circuit boards and for example be fixed or connected to the side of the circuit board that lies opposite to the entry side.

It may also be provided that the inner conductor and/or the outer housing of the connecting element is connected directly to the respective circuit board or to an electrical component, a strip line or a solder pad by soldering, crimping, pressing or another connecting technique. The use of a plug-in connector on one side and a direct connection on the other side may also be provided. In the context of the invention, the specific connecting technique is not of importance. The use of plug-in connectors and counterpart plug-in connectors is however particularly advantageous.

The connecting element may thus in particular be electrically conductively connected at a first end to a first circuit board and at a second end to a second circuit board, in order to form an electrical path. The electrical path may be usable for the transmission of electrical signals, in particular high-frequency signals, and/or for electrical power transfer.

It is preferable if the first plug-in connector and the second plug-in connector are designed to differ from one another. In particular, provision may be made whereby the outer diameter of the first contact region of the first plug-in connector increases in the direction of the first end of the connecting element, whereas the outer diameter of the first contact region of the second plug-in connector remains constant, for example tapers cylindrically to the second end of the connecting element.

In one embodiment of the connecting element, provision may be made whereby the electrically conductive material of the outer housing is non-magnetic. The electrically conductive material of the outer housing is preferably formed from a non-magnetic metal, particularly preferably from brass.

The term "non-magnetic" refers to a material on which a magnetic field has almost no effect or none at all. The property of a negligible capability of being magnetically influenced is sometimes also referred to as "amagnetic" or "unmagnetic". The material is preferably not ferromagnetic. In particular, the magnetic properties of non-ferrous metals, or metals without iron, in particular brass or tin bronze, have according to the invention been found in the context of high-frequency simulations to be particularly suitable. It is however also possible for other materials, but in particular non-magnetic or weakly magnetic metals, for example also various stainless steels, to be provided.

In one embodiment of the connecting element, provision may be made whereby the electrical cable and/or the connecting element is concentric and is formed preferably from precisely one inner conductor and one dielectric, which forms the cable jacket.

An electrical cable may also be provided which, in addition to an inner conductor, also comprises an outer conductor, wherein the inner conductor and the outer conductor are separated by an insulator, and the electrical cable further comprises a cable jacket, or the "dielectric" according to the invention, surrounding the outer conductor.

Since, in general, a single transmission channel is to be provided by each connecting element for the connection between electrical circuit boards, the use of an electrical cable that is formed by precisely one inner conductor and one dielectric or cable jacket surrounding the inner conductor has however been found to be particularly suitable.

A concentric structure is in particular suitable for use in high-frequency technology.

In one embodiment of the invention, provision may however also be made whereby the electrical cable and/or the connecting element comprises at least one inner conductor pair for differential signal transmission.

The inner conductor pairs may in particular run along the longitudinal axis of the connecting element or of the cable in a twisted manner (in the manner of a "twisted pair" cable). The inner conductor pairs may however also run parallel ("parallel pair").

When a plurality of inner conductors are used, the respective inner conductors may each be individually insulated from one another, in particular surrounded by a respective insulator. The dielectric according to the invention may then enclose the plurality of inner conductors collectively, for example in the manner of a cable jacket.

One individual inner conductor pair, or also a plurality of inner conductor pairs, for example two, three, four or even more inner conductor pairs, may then be provided for differential signal transmission.

Provision may be made whereby a plurality of portions of the outer housing are deformed along the longitudinal axis of the outer housing, wherein the portions may be arranged distributed along the longitudinal axis and/or radially on the outer surface of the outer housing, for example in the manner of notches.

In a particularly preferred embodiment of the connecting element, provision may however be made whereby the outer housing is deformed along precisely one contiguous portion of the outer housing.

In particular, if the connecting element is used for the transmission of high-frequency or high-bit-rate signals, a uniform deformation and, in particular, a deformation of a longest possible contiguous portion may be advantageous in order to transmit the electrical signals without disturbance, in particular without reflection.

A securing or mechanical fixing of the electrical cable by means of notches may for example constitute a location of electrical disturbance, which can be avoided to the best extent possible by means of a deformation of a single portion which preferably extends between the plug-in connectors of the connecting element.

In one embodiment of the invention, provision may be made whereby the at least one contiguous portion along which the outer housing is deformed extends at least along 50% of the total length of the outer housing, preferably at least along 75% of the total length of the outer housing, particularly preferably at least along 90% of the total length of the outer housing and very particularly preferably completely or over the full length between the plug-in connectors of the outer housing.

The above-stated values that the at least one contiguous portion preferably occupies along the total length of the outer housing can be achieved by means of a single contiguous portion or also in a manner distributed over a plurality of portions. The formation of one contiguous single portion is nevertheless to be preferred.

The portion along which the outer housing is deformed preferably extends centrally between the plug-in connectors of the outer housing, or centrally between the two ends of the outer housing.

For the provision of a connecting element that is as free as possible from disturbance sites and thus particularly suitable for high-frequency technology, it is particularly advantageous to deform the outer housing along a contiguous portion that extends fully between the plug-in connectors of the outer housing.

A transition region with variable outer diameter may be provided between the plug-in connectors, in particular round plug-in connectors with a first diameter, and the deformed portion of the outer housing with a second diameter.

In a preferred embodiment of the connecting element, provision may be made whereby the at least one portion of the outer housing is deformed in such a way that the cross section of the outer housing has, in the deformed segment, a perimeter that is not circular.

Preferably, the basic shape of the tubular outer housing or its cross section is circular, or the perimeter forms a circle (also referred to as the circle edge), and is brought into a different shape at least in the at least one portion by means of the deformation. A round geometry or a circular perimeter is, owing to the uniform distance of the wall of the outer housing from the inner conductor, particularly suitable for use in high-frequency technology, for which reason a round basic shape may be particularly preferred as the starting point for the outer housing.

In one embodiment of the connecting element, provision may be made whereby the cross section in the deformed portion comprises two, three, four, five, six or more angle segments uniformly distributed along the perimeter with a uniform, preferably constant radius and/or a uniform arc length.

Provision may be made whereby the angle segments distributed along the perimeter have a uniform radius and/or a uniform arc length.

The angle segments preferably have a constant radius. The radius of the angle segments may however also be variable along the perimeter of the angle segment, for example following an elliptical shape.

While a design of the angle segments with uniform radii and uniform arc lengths is to be preferred, a fixing of the electrical cable with adequate transmission properties may however also already result if the angle segments have a uniform radius or a uniform arc length.

Other variants of this which also lead to a fixing of the cable in the outer housing and can ensure adequate transmission properties are also presented below. It is nonetheless to be preferred if the angle segments have a uniform radius, preferably a constant radius, and a uniform arc length.

In this way, the connecting element is, in the at least one portion, brought into a shape that has a cross-section geometry in the case of which the angle segments have excellent high-frequency transmission properties as a result of the coaxiality. Between the angle segments with the uniform, preferably constant radius and the uniform arc length, respective (compensating) angle segments may be provided which receive the material displaced from the angle segments with the uniform radius and the uniform arc length during the deformation process. It has been found that the (compensating) angle segments impair the electrical transmission properties of the connecting element only to a negligible degree. The fixing of the electrical cable with the aid of the angle segments which each have a uniform radius and a uniform arc length however yields a high holding force, permits simple manufacture and, as already explained, has excellent high-frequency transmission properties. Preferably, precisely three angle segments with a uniform, preferably constant radius and a uniform arc length are provided so as to be distributed along the perimeter, between which respective (compensating) angle segments are formed.

The angle segments are preferably identical in design, and have an identical, constant radius and a uniform arc length. It is however also possible that the angle segments merely have an in each case uniform, constant radius or each have a uniform arc length.

In one embodiment of the invention, provision may furthermore be made whereby the angle segments have an identical but not constant radius. The angle segments may for example have, along their arc length or along the perimeter included therein, a course that does not correspond to a constant radius. For example, an elliptical course or some other course may be provided.

In a further embodiment of the invention, provision may be made whereby the angle segments have different courses along the perimeter or along the arc, which means, for example, that one proportion of the angle segments has a constant radius and another proportion has a variable radius. In the case of this embodiment, it is particularly advantageous if the different angle segments are arranged symmetrically, for example in such a way that the angle segments with deviating courses are arranged in each case in alternation. Provision may also be made whereby the angle segments are arranged in pairs in such a way that two identical angle segments are always located mirror-symmetrically opposite one another.

The angle segments may analogously also have different arc lengths, wherein the angle segments are again preferably arranged symmetrically, for example in such a way that angle segments with deviating arc lengths are arranged in alternation and/or that angle segments with identical arc lengths are arranged in pairs and are arranged mirror-symmetrically about the longitudinal axis of the connecting element.

In one embodiment of the invention, provision may be made whereby the at least one portion of the outer housing is deformed in such a way that the cross section of the outer housing corresponds, in the deformed portion, to a constant-width curve, preferably a Reuleaux triangle.

A "constant-width curve" is a curve of constant width, whose closed line always, in any orientation within a corresponding square, touches all four sides.

This results in a specific geometry of the outer housing which ensures a high mechanical holding force with, nevertheless, adequate coaxiality to ensure good signal transmission—in particular for high-frequency technology.

A constant-width curve geometry can bring about particularly good electrical properties, since in this way regions at a precise distance from the inner conductor can ensure suitable electrical matching. In the corner regions, the volume variation of the insulating part or of the dielectric and the diameter variation of the outer housing can be compensated without inadmissibly distorting the electrical matching.

In principle, a constant-width curve with a higher number of side faces than there are in a Reuleaux triangle may also be provided. A constant-width curve with four, five, six, seven, eight or even more side faces may for example be provided.

A constant-width curve with only two side faces, similar to an ellipse, may however also be provided. In general, however, this geometry is not preferred.

It may be provided in one embodiment of the invention that the outer housing is deformed by stamping or pressing or rolling.

According to one advantageous embodiment of the connecting element, provision may be made in particular whereby, if the outer housing is radially inwardly stamped or rolled in this way in the one or more portions in each case at three perimeter portions which are distributed with uniformly equidistant angle spacings along the perimeter, three perimeter portions which are arranged spaced apart from one another and which have a uniform, preferably constant radius and uniform arc length are formed.

Such an embodiment yields a high holding force with simultaneously excellent high-frequency transmission properties.

Preferably, three stamping jaws or stamping punches are used which, in a corresponding stamping or pressing process, convert the originally round cross-sectional geometry of the outer housing into the cross-sectional geometry with a constant width curve, in particular the Reuleaux triangle.

In principle, a connecting element with a cross-sectional geometry which has coaxiality in at least three angle segments, i.e. angle segments with constant radius, may be provided. In these regions, the connecting element can have excellent transmission properties for high-frequency technology. The slightly impaired coaxiality in the other segments then only negligibly impairs the electrical performance of the connecting element as a whole.

The overall diameter of the connecting element in the portion deformed along the longitudinal axis of the connecting element may amount to for example 2 to 8 mm, preferably 2.5 to 4 mm, particularly preferably approximately 3 mm. The diameter of the electrical cable may amount to for example 1 to 7 mm, preferably 1.5 to 2.5 mm, particularly preferably approximately 1.8 mm. The diameter of the inner conductor may amount to for example 0.5 mm to 1 mm, preferably approximately 0.7 mm. The length of the connecting element may amount to for example 7 to 60 mm, preferably 7 to 20 mm, particularly preferably approximately 10 mm. An expert may however in principle configure the dimensions of the connecting element as desired, in particular with regard to the respective application and the spacing of the circuit boards or electrical assemblies that are to be connected.

The invention furthermore relates to an assembly connection for connecting a first electrical assembly and a second electrical assembly, comprising a connecting element having a first plug-in connector arranged at a first end and having a second electrical plug-in connector arranged at a second end. The assembly connection furthermore comprises a first counterpart plug-in connector and a second counterpart plug-in connector, wherein the counterpart plug-in connectors are designed for connecting to the plug-in connectors of the connecting element and for connecting to in each case one electrical assembly.

It is also possible for multiple assembly connections to be provided for connecting the first electrical assembly to the second electrical assembly.

In the context of the assembly connection according to the invention, provision is made whereby the first counterpart plug-in connector comprises contact springs and the first plug-in connector comprises an electrically conductive outer housing with a first contact region which runs at least in ring-segment-shaped, or ring-shaped, circumferential fashion. The contact springs act via the first contact region on the outer housing in order to produce electrical contact and a mechanical connection between the first plug-in connector and the first counterpart plug-in connector.

With regard to the assembly connection according to the invention, provision is made whereby the contact springs act on the first contact region such that the outer housing is acted on with an axial force which acts along a longitudinal axis of the first counterpart plug-in connector and which pushes the outer housing against an axial end stop of the first counterpart plug-in connector. Alternatively or in addition, provision is made whereby the contact springs are designed such that they exert on the first contact region and on a second contact region of the outer housing, which second contact region runs at least in ring-segment-shaped, or ring-shaped, circumferential fashion and is axially offset with respect to the first contact region along a longitudinal axis of the connecting element, a respective radial force, which acts orthogonally with respect to the longitudinal axis of the first counterpart plug-in connector, on the outer housing.

With regard to the assembly connection according to the invention, provision may in particular be made whereby the outer diameter of the first contact region increases in the direction of the first end of the connecting element, and/or whereby the contact springs are designed so as to act on the outer housing via the second contact region.

According to the invention, self-centering of the connecting element may be realized by virtue of the connecting element being subjected to an axial force component and simultaneously a radial force component in its region of contact with the first counterpart plug-in connector.

In one refinement, provision may be made whereby the second plug-in connector is designed to differ from the first plug-in connector, and preferably comprises a first contact region which runs at least in ring-segment-shaped, or ring-shaped, circumferential fashion and which runs cylindrically along the longitudinal axis of the connecting element.

The invention also relates to a circuit board arrangement comprising at least one first circuit board and one second circuit board, wherein the circuit boards are arranged running parallel to one another in different planes.

In particular, those surfaces of the circuit boards that can be populated with electrical components run parallel to one another.

The circuit board arrangement may comprise an arbitrary number of circuit boards, but at least two. Even though the invention is described below by way of illustration substantially for the connection of two electrical circuit boards, the circuit board arrangement may however also comprise three circuit boards, four circuit boards, five circuit boards or even more circuit boards.

The circuit boards that are to be connected to one another are preferably arranged parallel to one another in different planes. In particular, a tolerance-induced deviation from the parallel arrangement, for example of up to 10°, preferably of up to 5° and particularly preferably of up to 4°, is to be understood here as being encompassed by the expression "parallel".

The circuit boards may lie directly against one another or preferably be spaced apart from one another, in particular with a gap between them.

With regard to the circuit board arrangement, provision is made whereby at least one connecting element is arranged between the circuit boards in order to electrically connect the circuit boards to one another, wherein the connecting element has an electrically conductive outer housing. Furthermore, at least one of the circuit boards has a first electrical counterpart plug-in connector with contact springs, wherein the contact springs act via a first contact region, which runs at least in ring-segment-shaped, or ring shaped, circumferential fashion, of a first electrical plug-in connector, which is arranged at a first end of the connecting element, on the outer housing in order to produce electrical contact and a mechanical connection between the first plug-in connector and the first counterpart plug-in connector.

With regard to the circuit board arrangement according to the invention, provision is furthermore made whereby the contact springs act on the first contact region such that the outer housing is acted on with an axial force which acts along a longitudinal axis of the first counterpart plug-in connector and which pushes the outer housing against an axial end stop of the first counterpart plug-in connector. Alternatively or in addition, provision is made whereby the contact springs are designed such that they exert on the first contact region and on a second contact region of the outer housing, which second contact region runs at least in ring-segment-shaped, or ring-shaped, circumferential fashion and is axially offset with respect to the first contact region along a longitudinal axis of the connecting element, a respective radial force, which acts orthogonally with respect to the longitudinal axis of the first counterpart plug-in connector, on the outer housing.

With regard to the circuit board arrangement according to the invention, provision may in particular be made whereby the outer diameter of the first contact region increases in the direction of the first end of the connecting element, and/or whereby the contact springs are designed so as to act on the outer housing via the second contact region.

By means of the design of the first contact region which widens in the direction of the first end of the connecting element, the contact force exerted normally (perpendicular to the first contact region of the connecting region) by the individual contact springs can, by contrast to the prior art, have a radial and simultaneously an axial force component. The axial component of the contact force can permit an orientation of the connecting element perpendicular to the first electrical assembly, and thus self-centering of the connecting element in the first counterpart plug-in connector.

The connecting element (without counterpart plug-in connector) may also be referred to as an adapter piece or "bullet", and is connected with its respective ends to the respective circuit board or plugged into a corresponding counterpart plug-in connector of the circuit board, or directly into the circuit board.

With the circuit board arrangement, at least one connecting element can be provided for connecting the circuit boards, but in principle an arbitrary number of connecting elements can be provided, for example two connecting elements, three connecting elements, four connecting elements, five connecting elements, ten connecting elements, fifty connecting elements, one hundred connecting elements or even more connecting elements. The expert may basically specify the number of connecting elements used in a manner dependent on the number of electrical signals to be transmitted, for example the number of necessary channels.

The invention furthermore relates to a method for the manufacture of a connecting element for connecting a first electrical assembly to a second electrical assembly, in which method an electrical cable comprising at least one inner conductor and one dielectric surrounding the at least one inner conductor is inserted along a longitudinal axis into a rigid, tubular outer housing. The outer housing is manufactured from an electrically conductive material, wherein at least one portion of the outer housing is deformed along the longitudinal axis after the insertion of the electrical cable in such a way that the electrical cable is fixed in the outer housing.

A deformation and joining method can thus be provided for the construction of a connecting element for a circuit board arrangement.

Preferably, the inner diameter of the outer housing is designed to be larger than the outer diameter of the electrical cable. Particularly easy joining or insertion of the electrical cable into the outer housing can be made possible in this way (clearance fit). The outer diameter of the deep-drawn part may for example be greater than the outer diameter of the electrical cable by 0.1% to 0.5%, for example also greater than the outer diameter of the electrical cable by up to 1%, 2%, 3%, 5% or even more.

During the installation of a connecting element, a cable blank or an electrical cable may be joined to a preferably drawn tube. Preferably, the joining process may take place with clearance fit, after which the tube or the outer housing is then radially upset. The cross section resulting from the deformation may in this case be designed in particular in such a way that both the mechanical as well as the electrical properties of the connecting element are optimized. High-frequency simulations may for example be used in advance for this purpose.

Through the optimization of the electrical properties of the connecting element with a simultaneously high mechanical holding force of the electrical cable in the outer housing, it is possible according to the invention to provide a connecting element with particularly fast and disturbance-free data transmission. The construction of the connecting element can furthermore be economical and thus suitable for mass production.

In particular, since fixing of the electrical cable in the outer housing is realized as a result of the deformation of the latter, it is also not possible for any chips, shavings or other abrasive damage to occur on the insulating part or on the dielectric during the manufacture of the connecting element.

Preferably, the electrical cable is manufactured from precisely one inner conductor, in particular one metallic inner conductor, which is then overmolded with a non-conductive material or a dielectric. The electrical cable may in principle also comprise yet further inner conductors. A concentric cable is preferably used.

In one embodiment, provision may be made whereby the outer housing is deep-drawn, extruded or turned from a metallic blank.

In particular, deep-drawing of the outer housing has been found to be particularly advantageous, since the outer housing in this case can be manufactured relatively economically and, as a result of the deformation according to the invention for fixing the electrical cable, the large tolerances or deviations from the specified dimension that may result from the deep-drawing are not particularly relevant.

In one embodiment, provision may furthermore be made whereby the at least one portion of the outer housing is deformed by stamping and/or rolling.

In principle, however, any desired deformation process, or any desired deformation technology, may be provided, including for example bending. A stamping or rolling technique is however particularly suitable. By means of the retroactive deformation of the outer housing, the electrical cable can even be joined with relatively large diameter tolerances, wherein a good mechanical fastening as well as an optimum electrical design can nevertheless also be realized. Deformation of the outer housing is however not imperatively necessary in the context of the invention.

An axial rolling process, that is to say a rolling along the longitudinal axis of the outer housing, may be provided.

A radial rolling process may however also be provided, in which rolling takes place radially or tangentially along the outer perimeter of the outer housing.

In principle, provision may be made whereby the portion of the outer housing is deformed by longitudinal rolling, forge rolling, transverse rolling, ring rolling and/or cross rolling.

In one embodiment of the method, provision may be made whereby the at least one portion of the outer housing is deformed by stamping using two or more stamping jaws, preferably three or more stamping jaws. The deformation is preferably done in such a way that the cross section of the deformed portion corresponds to a constant-width curve, preferably to a Reuleaux triangle.

The number of stamping jaws preferably corresponds to the number of side faces of the constant-width curve; thus, for example, three stamping jaws are provided for deforming the cross section into a Reuleaux triangle.

The cross section of the outer housing may comprise both regions that are very precisely defined by the closed stamping punch or stamping jaws and in which the mechanical and electrical properties dominate, as well as regions that compensate for the component tolerances and the clearance fit.

Other suitably designed pressing or stamping tools may also be used instead of stamping jaws or stamping punches.

In one embodiment, provision may in particular be made whereby the at least two stamping jaws each comprise a central region that forms a stamping surface, the course of which region corresponds to the course of the perimeter of the cross section of the outer housing after the stamping, and wherein the course of the stamping jaws in the outer regions around the central region is in each case set back toward the outside in order to receive material of the outer housing displaced by the stamping during the stamping process.

A region set back with respect to the central region of the cross section of the stamping jaws is, in particular, suitable for receiving material of the outer housing that is displaced as a result of tolerances.

The stamping punch, or each stamping jaw, may thus have a curvature in the central region, wherein the curvature corresponds to the curvature in the respectively adjacent region of the outer housing at the end of the stamping process.

In one embodiment, provision may be made whereby the outer housing is radially inwardly stamped or rolled in the one or more portions in each case at three perimeter portions which are distributed uniformly along the perimeter, in such a way that the three perimeter portions which are arranged spaced apart from one another are formed with a uniform, preferably constant radius and uniform arc lengths, wherein, between in each case two perimeter portions, there is formed a compensating portion which receives material displaced from the inwardly stamped or rolled perimeter portions.

The compensating portion, also already referred to above as the (compensating) perimeter portion, makes it possible for material displaced during the stamping or rolling process to escape. The stamping jaws or stamping punches may be designed accordingly.

Provision may be made whereby all the stamping jaws have the same curvature in their central region, such that angle segments with a uniform, preferably constant radius and a uniform arc length are formed. The radius does not necessarily have to be constant. Other curvatures are also possible here; an elliptical course may for example be provided. A constant radius is however to be preferred in order to achieve particularly good electrical transmission properties.

The stamping jaws may possibly also be designed in such a way that the arc lengths of the angle segments are not equal. The stamping jaws are preferably at least arranged such that they stamp or press the outer housing symmetrically, so that the cross-sectional area of the outer housing in the stamped or pressed region has a symmetrical form.

The connecting element according to the invention is preferably suitable for the transmission of high-frequency signals. The connecting element may however in principle also be used for the transmission of low-frequency signals or for the transmission of electrical supply signals.

Features that have already been described in conjunction with the electrical plug-in connection according to the invention can of course also be advantageously applied to the counterpart plug-in connector, the connecting element, the assembly connection and the circuit board arrangement—and vice versa. Advantages that have already been mentioned in conjunction with the electrical plug-in connection according to the invention can furthermore also be understood as relating to the counterpart plug-in connector, the connecting element, the assembly connection and the circuit board arrangement—and vice versa.

In addition, it should be noted that expressions such as "including", "comprising" or "with" do not exclude any other features or steps. Furthermore, expressions such as "a" or "the" that refer in the singular to steps or features do not exclude a plurality of steps or features—and vice versa.

It is pointed out at this juncture that the specific combinations of features stated in the dependent claims can also individually, in combination only with the preamble of the respective claim to which said dependent claims refer back, constitute independent inventions within the scope of the claimed overall concept of the invention.

The applicant in particular accordingly reserves the right to claim the following subjects as an independent invention:

the features stated in claim 4 in combination with the preamble of claim 1;

the features stated in claim 5 in combination with the preamble of claim 1;

the features stated in claim 6 in combination with the preamble of claim 1;

the features stated in claim 7 in combination with the features stated in claim 6 and the preamble of claim 1;

the features stated in claim 8 in combination with the features stated in claim 6 and the preamble of claim 1;

the features stated in claim 9 in combination with the features stated in claim 6 and the preamble of claim 1;

the features of the connecting element stated in claim 12 in combination with the features of the connecting element stated in the preamble of claim 1;

the features stated in claim 14 in combination with the preamble of claim 13.

The further claims and the features mentioned in the description as a whole relate to advantageous embodiments and variants of the independent inventions mentioned above.

BRIEF DESCRIPTIONS OF THE DRAWINGS

Exemplary embodiments of the invention will be described in more detail below with reference to the drawings.

The figures each show preferred exemplary embodiments in which individual features of the present invention are illustrated in combination with one another. Features of one exemplary embodiment may also be implemented separately from the other features of the same exemplary embodiment, and may accordingly be readily combined by an expert to form further useful combinations and sub-combinations with features of other exemplary embodiments.

Elements of identical function are denoted by the same reference designations in the figures.

In the figures, in each case schematically:

DETAILED WRITTEN DESCRIPTION OF THE PREFERRED EMBODIMENTS

Figure 1:
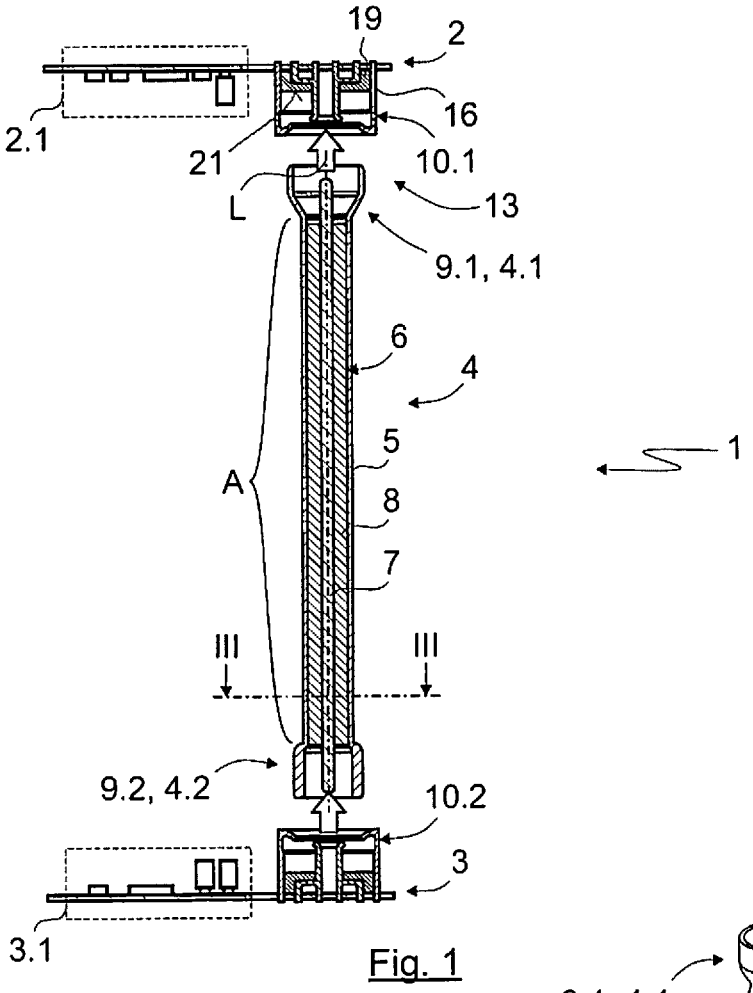
FIG. 1 is a sectional illustration of a circuit board arrangement comprising a first circuit board and a second circuit board as well as a connecting element arranged between the circuit boards.

FIG. 1 illustrates a circuit board arrangement 1 in a sectional illustration. The circuit board arrangement 1 comprises a first circuit board 2 and a second circuit board 3 which are arranged running parallel to one another in different planes. In the context of the invention, however, it is basically possible for yet further circuit boards to be provided.

A connecting element 4 is arranged between the circuit boards 2, 3 in order to electrically connect the circuit boards 2, 3 to one another. For the sake of clarity, FIG. 1 illustrates a state of the connecting element 4 in which it has not yet been plugged together with the circuit boards 2, 3.

All of the proportions illustrated in the drawings are to be understood merely as examples; in particular, the relative proportions of the circuit boards 2, 3, the connecting element 4 and the counterpart plug-in connectors 10.1, 10.2, 10.2' described below.

In principle, an arbitrary number of connecting elements 4 may be provided for the electrical and mechanical connection of the circuit boards 2, 3. The connecting element 4 may in particular connect an electrical circuit 2.1 of the first circuit board 2 to an electrical circuit 3.1 of the second circuit board 3.2, in particular for the transmission of high-bit-rate signals (not shown) between the electrical circuits 2.1, 3.1.

In principle, the connecting element 4 and the assembly connection 22 according to the invention are suitable for the mechanical and electrical connection between arbitrary electrical assemblies, in particular a first electrical assembly and a second electrical assembly. For illustrative purposes, however, the exemplary embodiment describes only the use of the connecting element 4 in relation to the connection of two circuit boards 2, 3; that is to say a concrete variant embodiment in which the first electrical assembly is formed as a first circuit board 3 and the second electrical assembly is formed as a second circuit board 4. This is however not to be understood as restricting the invention.

The connecting element 4 comprises a preferably rigid, tubular outer housing 5 composed of an electrically conductive material. One or more inner conductors 7 may be at least partially enclosed within in the outer housing 5. A dielectric 8, or multiple dielectrics, may also be provided. Merely by way of example, in the exemplary embodiment, an electrical cable 6 is provided in the outer housing 5, which cable is led along a longitudinal axis L of the outer housing 5 or of the connecting element 4.

The electrically conductive material of the outer housing 5 may preferably be non-magnetic, in particular composed of a non-magnetic material. Brass is preferably used.

The electrical cable 6 comprises at least one inner conductor 7, in the exemplary embodiment precisely one inner conductor 7, and a dielectric 8 surrounding the inner conductor 7. The electrical cable 6 illustrated in the exemplary embodiments is a concentrically configured electrical cable 6 composed of precisely one inner conductor 7 and one dielectric 8, which forms a cable jacket. In principle, however, provision may also be made whereby the electrical cable 6 comprises a plurality of inner conductors 7, for example at least one inner conductor pair, which is preferably provided for differential signal transmission.

The outer housing 5 of the connecting element 4 serves as outer conductor of the connecting element 4. The connecting element 4 has, at each of its ends 4.1, 4.2, a plug-in connector 9.1, 9.2 for connecting to a respective counterpart plug-in connector 10.1, 10.2 of the respective circuit board 2, 3. The inner conductor 7 is thereby also connected to the respective counterpart plug-in connector 10.1, 10.2. The plug-in connectors 9.1, 9.2 of the connecting element 4 are, as illustrated in the exemplary embodiment, preferably of round design.

In the exemplary embodiment, provision is made whereby the plug-in connectors 9.1, 9.2 are formed by virtue of the outer housing 5 being widened or having an increased diameter at its ends 4.1, 4.2.

At least one of the plug-in connectors 9.1, 9.2 may however also be omitted. The connecting element 4 can then possibly also be plugged directly into the circuit boards 2, 3, or connected to the circuit boards 2, 3 using any desired suitable connecting technique such as soldering or crimping.

During the course of the manufacture of the connecting element 4, provision may be made whereby at least one portion A, in the exemplary embodiment precisely one portion A, of the outer housing 5 is deformed along the longitudinal axis L in such a way that the electrical cable 6 is fixed in the outer housing 5. Here, the segment A may extend at least along 50% of the total length of the outer housing 5, but preferably along 75% of the total length of the outer housing 5, particularly preferably at least along 90% of the total length of the outer housing 5 and very particularly preferably all the way between the plug-in connectors 9.1, 9.2 of the outer housing 5, as is provided in the exemplary embodiment. In particular, if one of the plug-in connectors 9.1, 9.2 is omitted, the portion A may also extend entirely along the total length of the connecting element 4.

In principle, however, a deformation of one or more portions of the outer housing 5 may also be provided in the form of notching in order to fix the electrical cable 6 in the outer housing 5. With regard to the then impaired electrical properties, this is however not preferred. Deformation of the outer housing 5 is however basically not necessary in the context of the invention.

Figure 2:
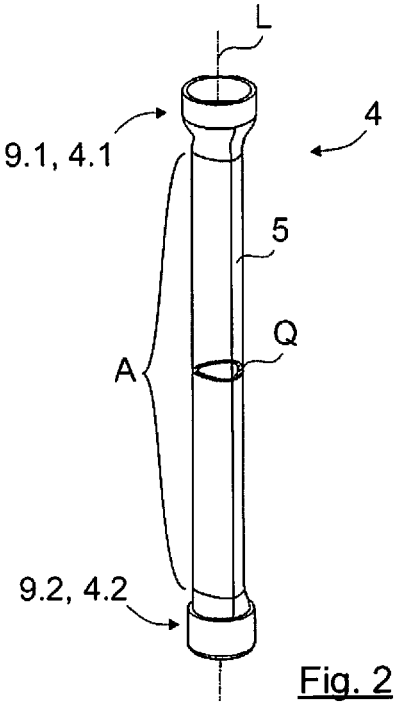
FIG. 2 is an isometric illustration of the outer housing of the connecting element of FIG. 1.

For the purposes of further illustration, FIG. 2 is an isometric illustration of the outer housing 5 of the connecting element 4 with a graphical emphasis of the cross section Q of the deformed portion A of the outer housing 5. The cross section Q resulting after the deformation is furthermore illustrated in FIG. 4.

A tubular outer housing 5 may be provided from a round, metallic blank, wherein the outer housing 5 is preferably deep drawn, extruded or turned from the metallic blank. Preferably, the at least one portion A of the outer housing 5 is then deformed in such a way that the cross section Q of the outer housing 5 in the deformed portion A is no longer round, or the perimeter no longer follows a circular path (cf. FIG. 2 and FIG. 4). Preferably, the at least one portion of the outer housing 5 is deformed in such a way that the cross section Q of the outer housing 5 follows a constant-width curve, in the exemplary embodiment a Reuleaux triangle, in the deformed portion A.

With regard to an advantageous manufacturing method of the connecting element 4, provision may be made whereby the electrical cable 6, which comprises the at least one inner conductor 7 and the dielectric 8, is inserted along the longitudinal axis L into the outer housing 5, preferably with an adequate press fit, after which the at least one portion A of the outer housing 5 is deformed along the longitudinal axis L in such a way that the electrical cable 6 is fixed in the outer housing 5.

The deformation of the portion A of the outer housing 5 may in this case be realized for example by stamping and/or rolling (axial or radial). The deformation is preferably realized by stamping. For the purposes of further illustration, FIGS. 3 and 4 show the cross section Q of the connecting element 4 prior to the stamping process (FIG. 3) and after the stamping process (FIG. 4).

Figure 3:
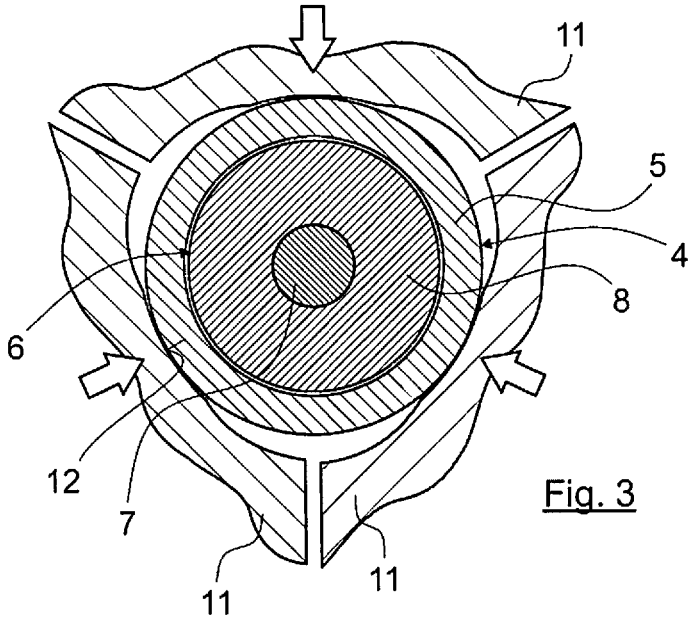
FIG. 3 is a cross section view of the connecting element of FIG. 1 taken along the section plane III illustrated in FIG. 1 prior to the deformation by means of three stamping jaws.
Figure 4:
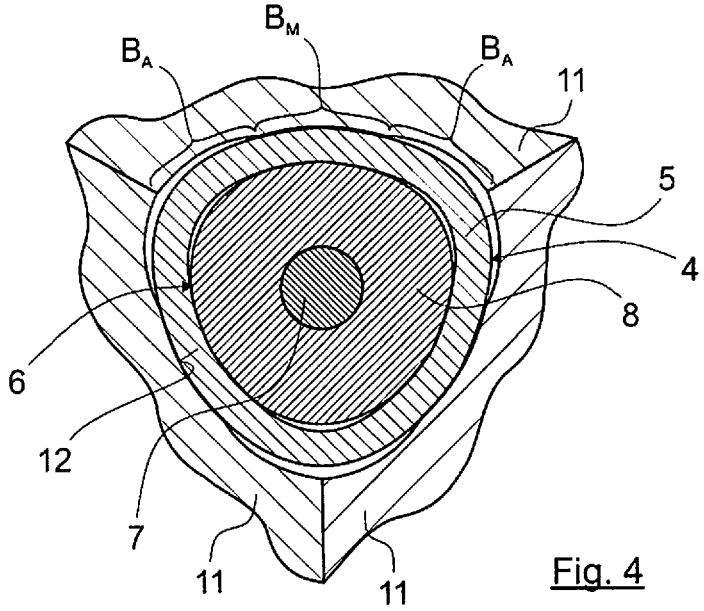
FIG. 4 is a cross section view of the connecting element of FIG. 1 taken along the section plane III illustrated in FIG. 1 after the deformation with the three stamping jaws.

As can be seen from FIG. 3, the outer diameter of the electrical cable 6 is designed to be smaller than the inner diameter of the outer housing 5 for the sake of easy insertion into the outer housing 5. A clearance is accordingly present between the outer housing 5 and the electrical cable 6.

Two or more stamping jaws 11 may be provided for fixing the electrical cable 6 by means of an advantageous stamping process. Three stamping jaws 11 are preferably provided, as illustrated in the exemplary embodiment, in particular in order to deform the portion A in such a way that the cross section Q after the deformation follows a constant-width curve, for example a Reuleaux triangle.

Here, the stamping surface 12 of the stamping jaws 11 may correspond in the cross section in a central region $B_M$ (cf. FIG. 4) to the course of the cross section Q of the outer housing 5 after the stamping. The outer regions $B_A$ (cf. FIG. 4) around the central region $B_M$ may each be set back in order to receive material of the outer housing 5 displaced by the stamping.

As can be seen in particular from FIG. 4, in the exemplary embodiment, provision is made whereby the outer housing 5 is radially inwardly pressed, inwardly stamped or rolled at three perimeter portions distributed uniformly along the perimeter in such a way that the three perimeter portions which are arranged spaced apart from one another and which have a uniform and constant radius and with uniform arc lengths are formed. These are the perimeter portions of the outer housing 5 that are formed by the central region $B_M$. Between in each case two of these perimeter portions, there is situated a compensating portion which receives material displaced from the inwardly pressed or inwardly stamped or rolled perimeter portions. The compensation portions are situated within the angle segments of the outer regions $B_A$, and are formed by in each case two adjacent outer regions $B_A$ of two stamping jaws 11 that are adjacent to one another.

Figure 5:
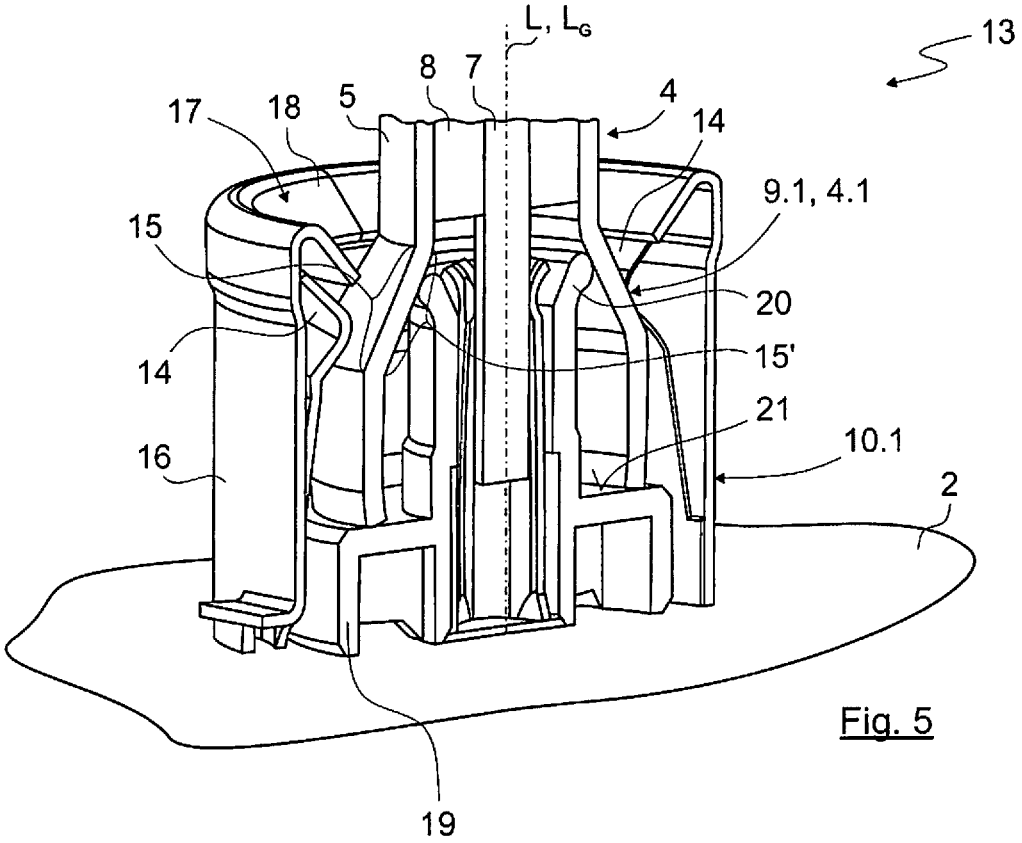
FIG. 5 is an isometric sectional illustration of an electrical plug-in connection according to the invention, having a first electrical plug-in connector and a first electrical counterpart plug-in connector.

FIG. 5 shows an electrical plug-in connection 13 according to the invention in a perspective sectional illustration. The plug-in connection 13 has a connecting element 4 with a first electrical plug-in connector 9.1 arranged at a first end 4.1, and has a first counterpart plug-in connector 10.1 of a first electrical assembly, in the present case the first circuit board 2 again by way of example.

The first counterpart plug-in connector 10.1 comprises contact springs 14 and the first plug-in connector 9.1 comprises an electrically conductive outer housing which is formed in one piece with the outer housing 5 of the connecting element 4 and which has a first contact region 15 which runs in ring-segment-shaped, or ring-shaped, circumferential fashion. The contact springs 14 act via the first contact region 15 on the outer housing 4 in order to produce electrical contact and a mechanical connection between the first plug-in connector 9.1 and the first counterpart plug-in connector 10.1.

Provision is made whereby the outer diameter of the first contact region 15 increases in the direction of the first end 4.1 of the connecting element 4.

Figure 14:
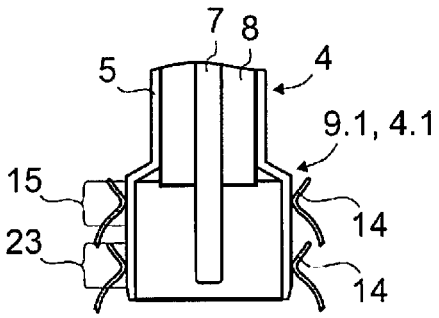
FIG. 14 shows an alternative embodiment of the first plug-in connector with a first contact region and with a second contact region.

Alternatively, or in addition, provision may be made whereby the contact springs 14 are designed so as to act on the outer housing 5 via a second contact region 23, which runs in ring-shaped circumferential fashion, of the outer housing 5, which second contact region is axially offset with respect to the first contact region 15 along the longitudinal axis L of the connecting element 4. This variant is illustrated merely by way of example in FIG. 14. The second contact region 23 and the first contact region 15 may also transition into one another. The first contact region 15 and the second contact region 23 may each have an axial extent which corresponds to the expected region in which the contact springs 14 are capable of acting on the first plug-in connector 9.1—possibly also taking into consideration tolerances and mechanical loading of plug-in connection 13.

Figure 7:
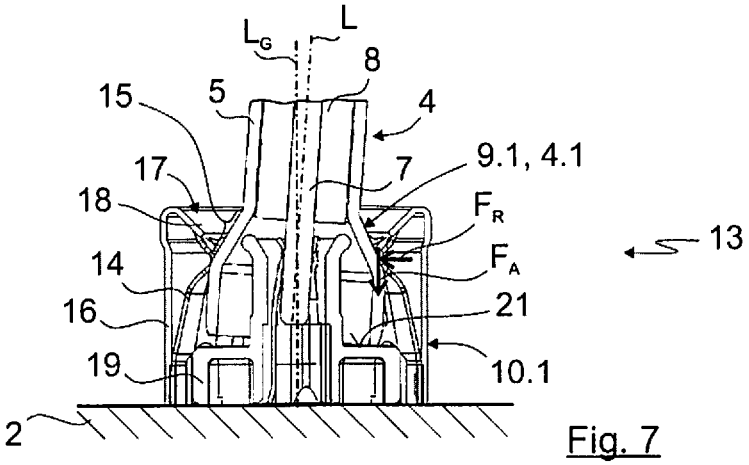
FIG. 7 shows the electrical plug-in connection of FIG. 6 after the insertion of the first plug-in connector into the first counterpart plug-in connector and prior to self-centering according to the invention.
Figure 8:
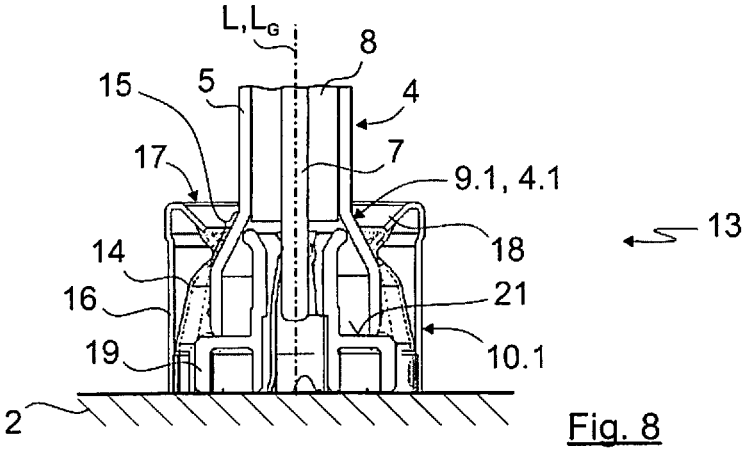
FIG. 8 shows the electrical plug-in connection of FIG. 7 after self-centering according to the invention.

The contact springs 14, the first contact region 15 and/or the second contact region 23 are designed such that the contact springs 14 exert a radial force component and an axial force component on the outer housing 5 such that the first plug-in connector 9.1 preferably assumes a coaxial alignment with respect to the first counterpart plug-in connector 10.1. This principle is illustrated in FIGS. 6 to 8.

Figure 6:
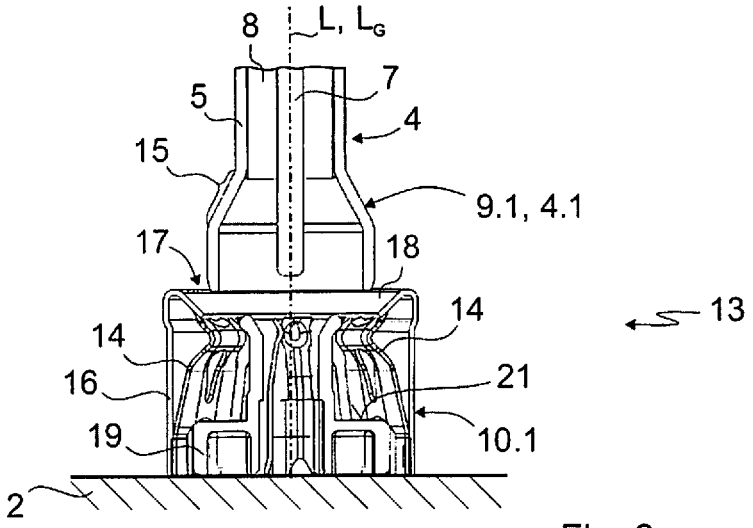
FIG. 6 is a sectional illustration of the electrical plug-in connection according to the invention of FIG. 5 in a state prior to the insertion of the first plug-in connector into the first counterpart plug-in connector.

FIG. 6 shows the first plug-in connector 9.1 and the first counterpart plug-in connector 10.1 in a non-plugged-together state. FIG. 7 shows a state in which the first plug-in connector 9.1 and the first counterpart plug-in connector 10.1 have already been plugged together, for example by a technician, but the connecting element 4 or the longitudinal axis L is still tilted relative to the longitudinal axis $L_G$ of the first counterpart plug-in connector 10.1. According to the invention, owing to the radial and axial force components of the contact springs 14, self-centering of the connecting element 4 or of the first plug-in connector 9.1 in the first counterpart plug-in connector 10.1 can be provided, which can preferably lead to a coaxial alignment as illustrated in FIG. 8.

Provision may preferably be made whereby the first counterpart plug-in connector 10.1 comprises a counterpart plug-in connector housing 16 with a funnel-shaped insertion region 17 for the first plug-in connector 9.1. As can be seen for example in FIG. 5, the funnel-shaped insertion region 17 is formed by a collar 18 which projects into the first plug-in connector 9.1 and which is simultaneously designed as an abutment for the contact springs 14 in order to mechanically preload the contact springs 14.

Figure 9:
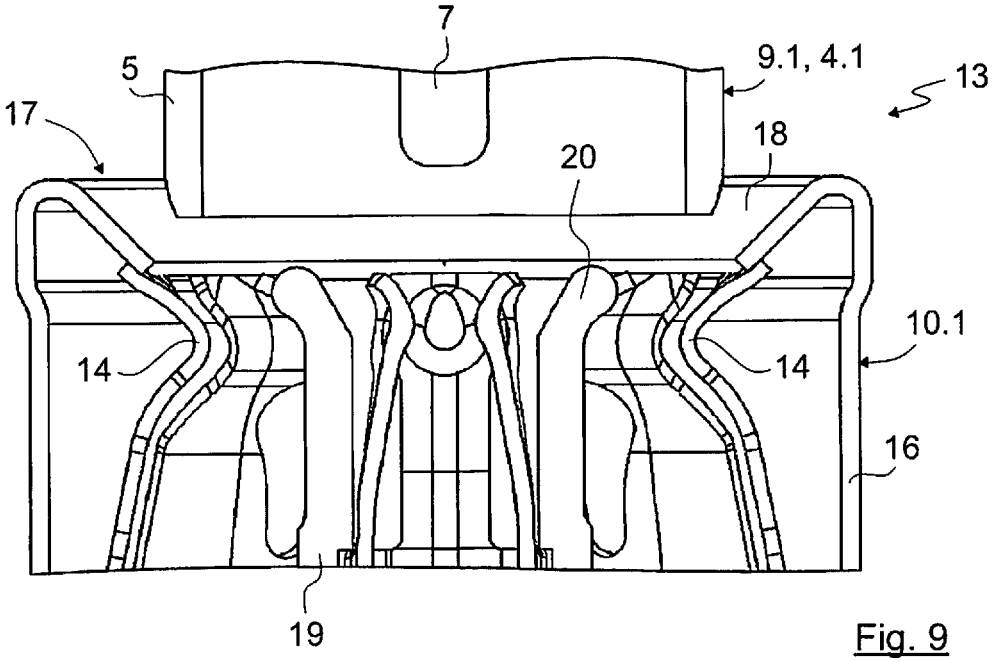
FIG. 9 is an enlarged sectional illustration of the contact region of the electrical plug-in connection of FIG. 5 for the purposes of illustrating the preload of the contact springs.

FIG. 9 shows an enlarged sectional illustration of the insertion region 17 of the first counterpart plug-in connector 10.1. In particular, the preload of the contact springs 14 owing to the stop, formed by means of the collar 18 of the counterpart plug-in connector housing 16, for the contact springs 14 can be clearly seen in FIG. 9.

In principle, however, a preload of the contact springs 14 in the first counterpart plug-in connector 10.1 may also be realized in some other way, or else may be omitted.

Figure 10:
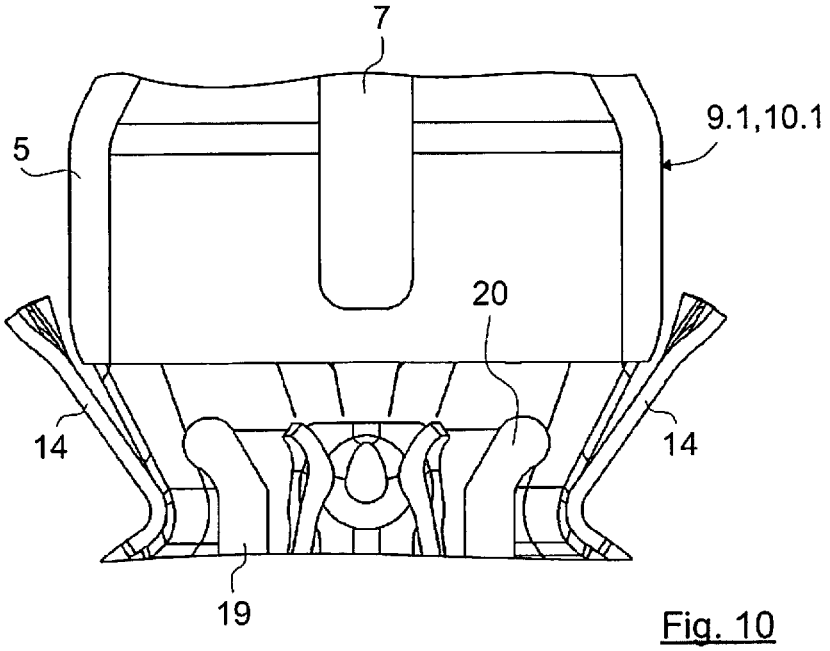
FIG. 10 is an enlarged sectional illustration of the contact region of an electrical plug-connection according to an exemplary embodiment with contact springs with a high degree of spring elasticity.

It may furthermore be advantageous to increase the elasticity of the contact springs 14 by means of a corresponding selection of the material of the contact springs 14 or a corresponding geometry of the contact springs 14. An exemplary geometry for achieving a high degree of contact spring elasticity is illustrated in FIG. 10.

In the exemplary embodiment, the outer diameter of the first contact region 15 increases conically and substantially linearly in the direction of the first end 4.1 of the connecting element 4. In principle, however, the outer diameter of the first contact region 15 may increase in accordance with any desired curve, for example may increase in convex or concave fashion.

As illustrated in the exemplary embodiments, the first counterpart plug-in connector 10.1 comprises an insulating part 19 which, as the first plug-in connector 9.1 is plugged together with the first counterpart plug-in connector 10.1, at least partially enters the outer housing 5 of the first plug-in connector 9.1. The insulating part 19 furthermore has a collar 20 pointing in the direction of the outer housing 5, in order to center the outer housing 5 in the first counterpart plug-in connector 10.1, in particular in order to compensate an axis offset. Furthermore, the insulating part 19 forms an axial end stop 21 for the first plug-in connector 9.1 in the first counterpart plug-in connector 10.1, against which end stop the connecting element 4 can be pressed, which further assists the self-centering.

Provision may be made whereby the insulating part 19 makes contact with the outer housing 5 at an inner contact region 15' which is situated opposite the first contact region 15 (cf. the plugged-together state of the plug-in connection 13 in FIG. 5). Here, the inner contact region 15' is arranged on the inner wall of the outer housing 5, and follows the geometry of the outer wall of the outer housing 5. The inner diameter of the inner contact region 15' of the outer housing 5 thus increases in the direction of the first end 4.1 of the connecting element 4. The collar 20 of the insulating part 19 advantageously makes contact with the inner contact region 15', wherein an axial offset of the contact points of the contact springs 14 with the first contact region 15 and of the collar 20 with the inner contact region 15' along the longitudinal axis L of the connecting element 4 can further assist the centering of the connecting element 4. The contact springs 14 and the collar 20 may however also make contact with the outer housing in the same "height plane" along the longitudinal axis L.

Figure 12:
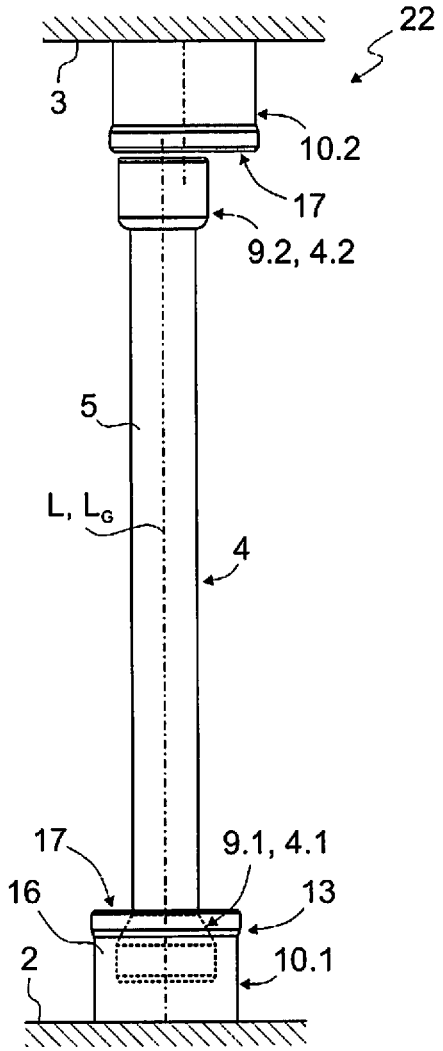
FIG. 12 shows an assembly connection according to the invention in a state after the insertion of the first plug-in connector into the first counterpart plug-in connector in a side view.

FIG. 12 shows an assembly connection 22 for connecting a first electrical assembly (the first circuit board 2 in the exemplary embodiment) and a second electrical assembly (the second circuit board 3 in the exemplary embodiment), comprising a connecting element 4 with a first electrical plug-in connector 9.1 arranged at a first end 4.1 and with a second electrical plug-in connector 9.2 arranged at a second end 4.2, and comprising a first counterpart plug-in connector 10.1 and a second counterpart plug-in connector 10.2. The counterpart plug-in connectors 10.1, 10.2 are designed for connecting to the plug-in connectors 9.1, 9.2 of the connecting element 4 and for connecting to in each case one electrical assembly or circuit board 2, 3. The first counterpart plug-in connector 10.1 has, for example, the contact springs 14 illustrated in FIGS. 5 to 9, and the first plug-in connector 9.1 has an electrically conductive outer housing 5 with a first contact region 15 which runs in ring-shaped circumferential fashion. The contact springs 14 act via the first contact region 15 on the outer housing 5 in order to produce electrical contact and a mechanical connection, for example also an arresting action, between the first plug-in connector 9.1 and the first counterpart plug-in connector 10.1.

According to the invention, a self-centering action can be provided for the illustrated assembly connection 22. In this way, the outer diameter of the first contact region 15 may increase in the direction of the first end 4.1 of the connecting element 4, and/or the contact springs 14 may be designed so as to act on the outer housing 5 via a second contact region 23 (cf. FIG. 14), which runs in ring-shaped circumferential fashion, of the outer housing 5, which second contact region is axially offset with respect to the first contact region 15 along the longitudinal axis L of the connecting element 4.

Figure 11:
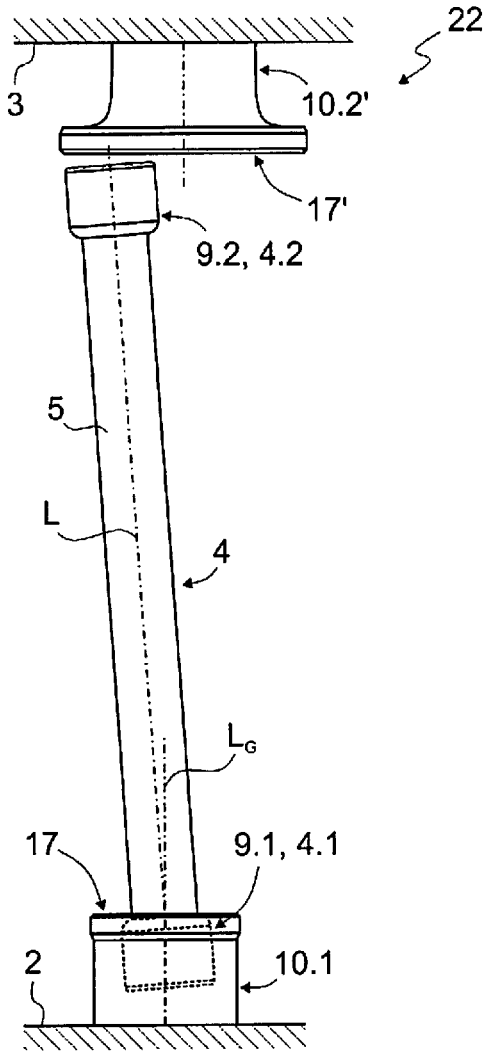
Fig. 11 PRIOR ART
FIG. 11 shows an assembly connection, according to the prior art, in a state after the insertion of the first plug-in connector into the first counterpart plug-in connector in a side view.

The principle of the self-centering can be clearly seen from a comparison of FIGS. 11 and 12. In FIG. 11, which shows an assembly connection 22 according to the prior art in a state after the plugging-together of the first plug-in connector 9.1 and of the first counterpart plug-in connector 10.1, the longitudinal axis L of the connecting element 4 of the prior art is still tilted relative to the longitudinal axis $L_G$ of the first counterpart plug-in connector 10.1 of the prior art. By contrast FIG. 12 illustrates a coaxial alignment of the connecting element 4 or of the first plug-in connector 9.1 with respect to the first counterpart plug-in connector 10.1 after the connecting element 4 has self-centered in accordance with the invention. The coaxial alignment of the first plug-in connector 9.1 in the first counterpart plug-in connector 10.1 leads, in the exemplary embodiment, to a parallel alignment of the longitudinal axis L of the connecting element 4 with respect to the longitudinal axis of the second counterpart plug-in connector 10.2.

Figure 13:
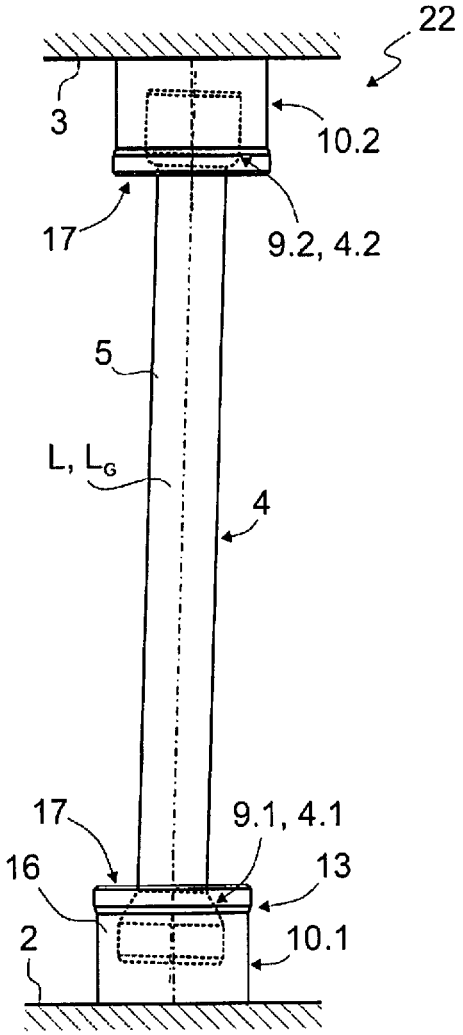
FIG. 13 shows the assembly connection according to the invention of FIG. 12 in a fully plugged-in state.

A particular advantage of the self-centering may consist in that the insertion region 17 of the counterpart plug-in connectors 10.1, 10.2 can be reduced in size in relation to the prior art. To illustrate this, FIGS. 11 to 13 illustrate a parallel offset of the longitudinal axis $L_G$ of the first counterpart plug-in connector 10.1 and of the longitudinal axis of the second counterpart plug-in connector 10.2 or 10.2'. Such an offset may arise for example as a result of a non-ideal alignment of the circuit boards 2, 3 relative to one another. In order to compensate the offset and permit uncomplicated, preferably blind plugging-together of the plug-in connectors 9.1, 9.2 with the counterpart plug-in connectors 10.1, 10.2, 10.2', the insertion region 17, 17' of the counterpart plug-in connectors 10.1, 10.2, 10.2' must be provided with correspondingly large dimensions, which increases the diameter of the entire counterpart plug-in connector 10.1, 10.2, 10.2' as a whole. An oblique position of the connecting element 4 in the first counterpart plug-in connector 10.1 can further exacerbate this problem, as can be clearly seen from a comparison of FIGS. 11 and 12. Owing to the alignment according to the invention of the connecting element 4 in the first counterpart plug-in connector 10.1, the insertion region 17 of the second counterpart plug-in connector 10.2 can be considerably reduced in size in relation to the insertion region 17' of the second counterpart plug-in connector 10.2' of the prior art.

FIG. 13 shows a fully plugged-together assembly connection 22 according to the present invention. To compensate the lateral offset of the longitudinal axis L of the connecting element 4 and of the longitudinal axis of the second counterpart plug-in connector 10.2, the connecting element 4 is again situated in a slightly oblique position in the fully plugged-together state, which however generally does not pose a problem.

As can be seen in particular from FIGS. 1, 2, 12 and 13, the second plug-in connector 9.2 of the assembly connection 22 is designed to differ from the first plug-in connector 9.1. In the exemplary embodiment, the first plug-in connector 9.1 has the first contact region 15, which runs in ring-shaped circumferential fashion and the outer diameter of which increases toward the first end 4.1 of the connecting element 4. By contrast, the second plug-in connector 9.2 has a first contact region which runs in ring-shaped circumferential fashion and which runs cylindrically, and thus with a constant outer diameter, along the longitudinal axis L of the connecting element 4.

Provision may however basically also be made whereby the first plug-in connector 9.1 and the second plug-in connector 9.2 are of similar or identical design.

An electrical plug-in connection (13), comprising a connecting element (4) with a first electrical plug-in connector (9.1) arranged at a first end (4.1) and comprising a first electrical counterpart plug-in connector (10.1), wherein the first counterpart plug-in connector (10.1) comprises contact springs (14) and the first plug-in connector (9.1) comprises an electrically conductive outer housing (5) with a first contact region (15) which runs at least in ring-segment-shaped circumferential fashion, and wherein the contact springs (14) act via the first contact region (15) on the outer housing (5) in order to produce electrical contact and a mechanical connection between the first plug-in connector (9.1) and the first counterpart plug-in connector (10.1), characterized in that the contact springs (14) act on the first contact region (15) such that the outer housing (5) is acted on with an axial force ($F_A$) which acts along a longitudinal axis ($L_G$) of the first counterpart plug-in connector (10.1) and which pushes the outer housing (5) against an axial end stop (21) of the first counterpart plug-in connector (10.1), and/or in that the contact springs (14) are designed such that they exert on the first contact region (15) and on a second contact region (23) of the outer housing (5), which second contact region runs at least in ring-segment-shaped circumferential fashion and is axially offset with respect to the first contact region (15) along a longitudinal axis (L) of the connecting element (4), a respective radial force ($F_R$), which acts orthogonally with respect to the longitudinal axis ($L_G$) of the first counterpart plug-in connector (10.1), on the outer housing (5).

An electrical plug-in connection characterized in that the outer diameter of the first contact region (15) increases in the direction of the first end (4.1) of the connecting element (4).

An electrical plug-in connection (13) characterized in that the contact springs (14) are designed so as to act on the outer housing (5) via the second contact region (23).

An electrical plug-in connection (13) characterized in that the first counterpart plug-in connector (10.1) comprises a counterpart plug-in connector housing (16) with a funnel-shaped insertion region (17) for the first plug-in connector (9.1).

An electrical plug-in connection (13) characterized in that the counterpart plug-in connector housing (16) comprises a collar (18) which projects into the first counterpart plug-in connector (10.1) and which is designed as an abutment for the contact springs (14) in order to mechanically preload the contact springs (14).

An electrical plug-in connection (13) characterized in that the first plug-in connector (10.1) comprises an insulating part (19) which, as the first plug-in connector (9.1) is plugged together with the first counterpart plug-in connector (10.1), at least partially enters the outer housing (5) of the first plug-in connector (9.1).

An electrical plug-in connection (13) characterized in that the insulating part (19) makes contact with the outer housing (5) at an inner contact region (15'), which is situated opposite the first contact region (15), of the outer housing (5) in the plugged-together state of the first plug-in connector (9.1) and of the first counterpart plug-in connector (10.1).

An electrical plug-in connection (13) characterized in that the insulating part (19) forms a collar (20) pointing in the direction of the outer housing (5), in order to center the outer housing (5) in the first counterpart plug-in connector (10.1).

An electrical plug-in connection (13) characterized in that the insulating part (19) forms the axial end stop (21) for the first plug-in connector (9.1) in the first counterpart plug-in connector (10.1).

A connecting element (4) for connecting a first electrical assembly (2) to a second electrical assembly (3), comprising a rigid, tubular outer housing (5) made of an electrically conductive material and an electrical cable (6) running inside the outer housing (5) along a longitudinal axis (L) of the outer housing (5), wherein the electrical cable (6) comprises at least one inner conductor (7) and a dielectric (8) surrounding the at least one inner conductor (7), and wherein at least one portion (A) of the outer housing (5) is deformed along the longitudinal axis (L) in such a way that the electrical cable (6) is fixed inside the outer housing (5).

An assembly connection (22) for connecting a first electrical assembly (2) and a second electrical assembly (3), comprising a connecting element (4) with a first electrical plug-in connector (9.1) arranged at a first end (4.1) and a second electrical plug-in connector (9.2) arranged at a second end (4.2) and comprising a first electrical counterpart plug-in connector (10.1) and a second electrical counterpart plug-in connector (10.2), wherein the counterpart plug-in connectors (10.1, 10.2) are designed for connecting to the plug-in connectors (9.1, 9.2) of the connecting element (4) and for connecting to in each case one electrical assembly (2, 3), wherein the first counterpart plug-in connector (10.1) comprises contact springs (14) and the first plug-in connector (9.1) comprises an electrically conductive outer housing (5) with a first contact region (15) which runs at least in ring-segment-shaped circumferential fashion, and wherein the contact springs (14) act via the first contact region (15) on the outer housing (5) in order to produce electrical contact and a mechanical connection between the first plug-in connector (9.1) and the first counterpart plug-in connector (10.1), characterized in that the contact springs (14) act on the first contact region (15) such that the outer housing (5) is acted on with an axial force ($F_A$) which acts along a longitudinal axis ($L_G$) of the first counterpart plug-in connector (10.1) and which pushes the outer housing (5) against an axial end stop (21) of the first counterpart plug-in connector (10.1), and/or in that the contact springs (14) are designed such that they exert on the first contact region (15) and on a second contact region (23) of the outer housing (5), which second contact region runs at least in ring-segment-shaped circumferential fashion and is axially offset with respect to the first contact region (15) along a longitudinal axis (L) of the connecting element (4), a respective radial force ($F_R$), which acts orthogonally with respect to the longitudinal axis ($L_G$) of the first counterpart plug-in connector (10.1), on the outer housing (5).

An assembly connection (22) characterized in that the second plug-in connector (9.2) is designed to differ from the first plug-in connector (9.1), and preferably comprises a first contact region which runs at least in ring-segment-shaped circumferential fashion and which runs cylindrically along the longitudinal axis (L) of the connecting element (4).

A circuit board arrangement (1), comprising at least one first circuit board (2) and one second circuit board (3), wherein the circuit boards (2, 3) are arranged running parallel to one another in different planes, and wherein, between the circuit boards (2, 3), at least one connecting element (4) is arranged in order to electrically connect the circuit boards (2, 3) to one another, wherein the connecting element (4) comprises an electrically conductive outer housing (5), and wherein at least one of the circuit boards (2, 3) comprises a first electrical counterpart plug-in connector (10.1) with contact springs (14), wherein the contact springs (14) act via a first contact region (15), which runs at least in ring-segment-shaped circumferential fashion, of a first electrical plug-in connector (9.1), which is arranged at a first end (4.1) of the connecting element (4), on the outer housing (5) in order to produce electrical contact and a mechanical connection between the first plug-in connector (9.1) and the first counterpart plug-in connector (10.1), characterized in that the contact springs (14) act on the first contact region (15) such that the outer housing (5) is acted on with an axial force ($F_A$) which acts along a longitudinal axis ($L_G$) of the first counterpart plug-in connector (10.1) and which pushes the outer housing (5) against an axial end stop (21) of the first counterpart plug-in connector (10.1), and/or in that the contact springs (14) are designed such that they exert on the first contact region (15) and on a second contact region (23) of the outer housing (5), which second contact region runs at least in ring-segment-shaped circumferential fashion and is axially offset with respect to the first contact region (15) along a longitudinal axis (L) of the connecting element (4), a respective radial force ($F_R$), which acts orthogonally with respect to the longitudinal axis ($L_G$) of the first counterpart plug-in connector (10.1), on the outer housing (5).

I claim:

1. An electrical plug-in connection comprising:

a connecting element with a first electrical plug-in connector arranged at a first end and comprising a first electrical counterpart plug-in connector, wherein the first counterpart plug-in connector comprises contact springs, and the first electrical plug-in connector comprises an electrically conductive outer housing with a first contact region which runs at least in ring-segment-shaped circumferential fashion, and wherein at least a portion of an outer diameter of the first contact region is sloped radially outwardly relative to a longitudinal axis of the connecting element such that the sloped outer diameter of the first contact region is larger proximate the first end of the connecting element, and wherein the contact springs act, via the sloped first contact region, on the outer housing in order to produce electrical contact, and a mechanical connection, between the first plug-in connector and the first counterpart plug-in connector, characterized in that the contact springs act on the sloped first contact region such that the outer housing is acted on with an axial force which acts along a longitudinal axis of the first counterpart plug-in connector and which pushes the outer housing against an axial end stop of the first counterpart plug-in connector, wherein the first electrical counterpart plug-in connector comprises an insulating part which forms the axial end stop for the outer housing of the first electrical plug-in connector in the first electrical counterpart plug-in connector; and wherein the axial end stop does not produce electrical contact between the first electrical plug-in connector and the first electrical counterpart plug-in connector.

2. The electrical plug-in connection according to claim 1, characterized in that an outer diameter of the first contact region increases in a direction of the first end of the connecting element.

3. The electrical plug-in connection according to claim 1, characterized in that the contact springs are designed so as to act on the outer housing via a second contact region.

4. The electrical plug-in connection according to claim 1, characterized in that the first electrical counterpart plug-in connector comprises a counterpart plug-in connector housing with a funnel-shaped insertion region for the first electrical plug-in connector.

5. The electrical plug-in connection according to claim 1, characterized in that a counterpart plug-in connector housing comprises a collar which projects into the first electrical counterpart plug-in connector and which is designed as an abutment for the contact springs in order to mechanically preload the contact springs.

6. The electrical plug-in connection according to claim 1, characterized in that the insulating part of the first electrical counterpart plug-in connector, as the first electrical plug-in connector is plugged together with the first electrical counterpart plug-in connector, at least partially enters the outer housing of the first electrical plug-in connector.

7. The electrical plug-in connection according to claim 1, characterized in that the insulating part of the first electrical counterpart plug-in connector makes contact with the outer housing of the first electrical plug-in connector at an inner contact region, which is situated opposite the first contact region of the outer housing in the plugged-together state of the first electrical plug-in connector and of the first electrical counterpart plug-in connector.

8. The electrical plug-in connection according to claim 1 characterized in that the insulating part of the first electrical counterpart plug-in connector forms a collar pointing in a direction of the outer housing of the first plug-in connector, in order to center the outer housing in the first electrical counterpart plug-in connector.

9. A connecting element for an electrical plug-in connection comprising:

a first electrical plug-in connector arranged at a first end of the connecting element for mating to a first electrical counterpart plug-in connector of a first electrical assembly, and wherein the first electrical plug-in connector has an electrically conductive outer housing with a first contact region which runs at least in ring-segment-shaped circumferential fashion and being designed to interact with contact springs of the first electrical counterpart plug-in connector to produce electrical contact; and a mechanical connection between the first electrical plug-in connector and the first electrical counterpart plug-in connector, and wherein the first electrical plug-in connector further has an inner contact region for making contact with an insulating part of the first electrical counterpart plug-in connector, the inner contact region being situated opposite the first contact region; and an outer diameter of the first contact region and an inner diameter of the inner contact region increase in p direction of the first end of the connecting element.

10. A connection element according to claim 9 for connecting a first electrical assembly to a second electrical assembly, comprising a rigid, tubular outer housing made of an electrically conductive material and an electrical cable running inside the outer housing along a longitudinal axis of the outer housing, wherein the electrical cable comprises at least one inner conductor and a dielectric surrounding the at least one inner conductor, and wherein at least one portion of the outer housing is deformed along the longitudinal axis in such a way that the electrical cable is fixed inside the outer housing.

11. Assembly connection for connecting a first electrical assembly and a second electrical assembly, comprising:

a connecting element with a first electrical plug-in connector arranged at a first end and a second electrical plug-in connector arranged at a second end and comprising a first electrical counterpart plug-in connector and a second electrical counterpart plug-in connector, wherein the counterpart plug-in connectors are designed for connecting to the plug-in connectors of the connecting element and for connecting to in each case one electrical assembly, wherein the first counterpart plug-in connector comprises contact springs and the first plug-in connector comprises an electrically conductive outer housing with a first contact region which runs at least in ring-segment-shaped circumferential fashion, and wherein the contact springs act via the first contact region on the outer housing in order to produce electrical contact and a mechanical connection between the first plug-in connector and the first counterpart plug-in connector, characterized in that the contact springs act on the first contact region such that the outer housing is acted on with an axial force which acts along a longitudinal axis of the first counterpart plug-in connector and which pushes the outer housing against an axial end stop of the first counterpart plug-in connector, and/or in that the contact springs are designed such that they exert on the first contact region and on a second contact region of the outer housing, which second contact region runs at least in ring-segment-shaped circumferential fashion and is axially offset with respect to the first contact region along a longitudinal axis of the connecting element, a respective radial force, which acts orthogonally with respect to the longitudinal axis of the first counterpart plug-in connector, on the outer housing.

12. Assembly connection according to claim 11, characterized in that the second plug-in connector is designed to differ from the first plug-in connector, and preferably comprises a first contact region which runs at least in ring-segment-shaped circumferential fashion and which runs cylindrically along the longitudinal axis of the connecting element.

13. Circuit board arrangement, comprising:

at least one first circuit board and one second circuit board, wherein the circuit boards are arranged running parallel to one another in different planes, and wherein, between the circuit boards, at least one connecting element is arranged in order to electrically connect the circuit boards to one another, wherein the connecting element comprises an electrically conductive outer housing, and wherein at least one of the circuit boards comprises a first electrical counterpart plug-in connector with contact springs, wherein the contact springs act via a first contact region, which runs at least in ring-segment-shaped circumferential fashion, of a first electrical plug-in connector, which is arranged at a first end of the connecting element, on the outer housing in order to produce electrical contact and a mechanical connection between the first plug-in connector and the first counterpart plug-in connector, characterized in that the contact springs act on the first contact region such that the outer housing is acted on with an axial force which acts along a longitudinal axis of the first counterpart plug-in connector and which pushes the outer housing against an axial end stop of the first counterpart plug-in connector, and/or in that the contact springs are designed such that they exert on the first contact region and on a second contact region of the outer housing, which second contact region runs at least in ring-segment-shaped circumferential fashion and is axially offset with respect to the first contact region along a longitudinal axis of the connecting element, a respective radial force, which acts orthogonally with respect to the longitudinal axis of the first counterpart plug-in connector, on the outer housing.

* * * * *